US008540097B1

(12) United States Patent
Robbins, III et al.

(10) Patent No.: US 8,540,097 B1
(45) Date of Patent: Sep. 24, 2013

(54) BOTTLE WITH RECESSED MOVABLE HANDLE

(71) Applicants: Edward S. Robbins, III, Muscle Shoals, AL (US); Brian T. William, Florence, AL (US)

(72) Inventors: Edward S. Robbins, III, Muscle Shoals, AL (US); Brian T. William, Florence, AL (US)

(73) Assignee: Edward S. Robbins, III, Muscle Shoals, AL (US)

( * ) Notice: Subject to any disclaimer, the term of this patent is extended or adjusted under 35 U.S.C. 154(b) by 0 days.

(21) Appl. No.: 13/661,947

(22) Filed: Oct. 26, 2012

Related U.S. Application Data

(63) Continuation-in-part of application No. 13/595,739, filed on Aug. 27, 2012.

(51) Int. Cl.
*B65D 23/10* (2006.01)
*B65D 25/28* (2006.01)

(52) U.S. Cl.
USPC ..... 215/396; 215/384; 220/761; 220/770

(58) Field of Classification Search
USPC ..... 215/396, 398; 220/761, 770, 772, 220/767, 752; 16/409, 410
See application file for complete search history.

(56) References Cited

U.S. PATENT DOCUMENTS

| | | | | |
|---|---|---|---|---|
| 2,005,528 | A * | 6/1935 | Berchulc | 220/754 |
| 2,009,192 | A * | 7/1935 | Freysinger | 383/14 |
| 3,025,997 | A * | 3/1962 | Matusky et al. | 220/761 |
| 3,104,010 | A * | 9/1963 | Pence | 206/9 |
| 3,419,196 | A * | 12/1968 | Moore | 222/465.1 |
| 3,491,913 | A | 1/1970 | Giraudet et al. | |
| 3,581,930 | A * | 6/1971 | Gunnink | 220/675 |
| 3,734,336 | A * | 5/1973 | Rankow et al. | 220/516 |
| 4,915,241 | A | 4/1990 | Morimura et al. | |
| 4,923,082 | A | 5/1990 | Bird | |
| 5,002,193 | A | 3/1991 | Touzani | |
| 5,647,624 | A * | 7/1997 | Beshara, Jr. | 294/27.1 |
| 5,769,256 | A * | 6/1998 | Medal | 215/398 |
| 5,988,418 | A | 11/1999 | Maeshima | |
| 6,003,703 | A * | 12/1999 | Ruggeri et al. | 215/396 |
| 6,019,241 | A * | 2/2000 | Burns | 220/570 |
| 7,805,886 | B2 | 10/2010 | Brandstatter | |
| 2011/0168729 | A1 * | 7/2011 | Koenig et al. | 220/761 |

* cited by examiner

*Primary Examiner* — Mickey Yu
*Assistant Examiner* — Niki Eloshway
(74) *Attorney, Agent, or Firm* — Brinks Holfer Gilson & Lione

(57) ABSTRACT

A container enclosing a prescribed volume having a sidewall including at least one of recess, each recess including at least one socket portion. A handle element adapted to be received in each recess, each of the handle element including at least one ball portion received in the socket portion of the recess, the ball portion being pivotable within the socket portion so as to permit the handle element to be displaced from within the sidewall recesses to a position projecting outward from the sidewall sufficiently to permit the a middle portion of the handle element to be grasped in one hand by a user of the container.

19 Claims, 23 Drawing Sheets

BOTTLE WITH RECESSED MOVABLE HANDLE

CROSS-REFERENCE TO RELATED APPLICATION

This is a Continuation-In-Part of application Ser. No. 13/595,739 filed Aug. 27, 2012, which is hereby incorporated by reference.

BACKGROUND

This invention relates to containers generally formed as integral one-piece plastic receptacles suitable for use in the distribution and consumption of milk, water, carbonated and non-carbonated beverages, other liquids and free-flowing particulates, the containers including a handle that is movable between recesses in the sidewall of the container and an extended position protruding beyond the sidewall of the container.

Containers for flowable products, such as liquids and granular products, have been formed of plastic and other materials by a variety of methods. For example, containers have been formed as an integral container body, neck finish and handle. Other containers have been formed with an integral container body and neck finish, and a separate handle later attached to the container body after completion of the container formation process. Still other containers have been formed by positioning an integral handle and a neck finish in a blow mold, whereby during blow molding of the container body (from a separate preform placed in the blow mold) the handle and the neck finish become attached to the container body. The blow molding process can include both extrusion-blow molding and injection-blow molding. Some containers have used a different plastic material for the handle than for the container body for reasons such as strength, color, aesthetics or cost. Some containers have also provided a separate handle that is attachable to the already formed container.

Little attention has been paid to considering the formation of such containers to allow for a change in the handle between a compact conformation during shipping and storage, and a more user-friendly expanded conformation during use by the end consumer. What is needed is a container having handles that can be stored in a non-extending manner and, when needed by the consumer, deployed for easy handling of the container.

SUMMARY

In one embodiment, a container can be a bottle enclosing a prescribed volume. The bottle can include a base, a sidewall extending upward from the base, a shoulder extending upward and inward from the sidewall to a finish surrounding an opening into the bottle, the finish being adapted to receive a closure. The sidewall can include a pair of recesses situated on opposite sides of a vertical midline, with at least one passage extending between the pair of recesses. The container can also include a handle having first and second portions adapted to be received wholly within the pair of recesses in the sidewall. Connecting portions can extend through the at least one passage to connect the first and second handle portions to each other. The connecting portions can include a hinge permitting the first and second portions to be displaced from within the sidewall recesses to a position projecting outward from the sidewall sufficiently to permit the first and second portions to be grasped in one hand by a user of the container.

In a preferred embodiment, at least two passages are formed between the pair of recesses so that two connecting portions join the first and second handle portions to provide enhanced strength and better control of the container during use. The first and second handle portions and connecting portion can be formed of a material that is different than that forming the bottle.

In another embodiment, a container has a bottle enclosing a prescribed volume having a sidewall including a pair of recesses situated on opposite sides of a vertical midline, each of the recesses including at least one socket portion. A pair of handles adapted to be received in the pair of recesses, each of the handle elements including at least one ball portion received in the at least one socket portion of one of the recesses, the at least one ball portions being pivotable within the at least one socket portions so as to permit the first and second portions to be displaced from within the sidewall recesses to a position projecting outward from the sidewall sufficiently to permit the first and second portions to be grasped in one hand by a user of the container.

In another embodiment, a container has a bottle enclosing a prescribed volume having a sidewall including a single recess including a vertically spaced pair of socket portion. A handle element can be adapted to be received in the pair of socket portions in the recess, with the handle element including a vertically spaced pair of ball portions received in the vertically spaced pair of socket portions, the ball portions being pivotable within the socket portions so as to permit the handle portions to be displaced from within the sidewall recesses to a position projecting outward from the sidewall sufficiently to permit the handle portion to be grasped in one hand by a user of the container.

In another embodiment, a container can be in the form of a cup designed to retain a prescribed volume, with or without a cooperating top, having a sidewall including at least one recess, each recess including at least one socket portion. At least one handle can be adapted to be received in each recess, each handle element including at least one ball portion received in the at least one socket portion of each recess, the at least one ball portions being pivotable within the at least one socket portion so as to permit each handle element to be displaced from within a sidewall recesses to a position projecting outward from the sidewall sufficiently to permit the handle portions to be grasped in one hand by a user of the container.

Other features of the present containers and the corresponding advantages of those features will become apparent from the following discussion of preferred embodiments, which are illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF PREFERRED EMBODIMENTS

Figure 1:
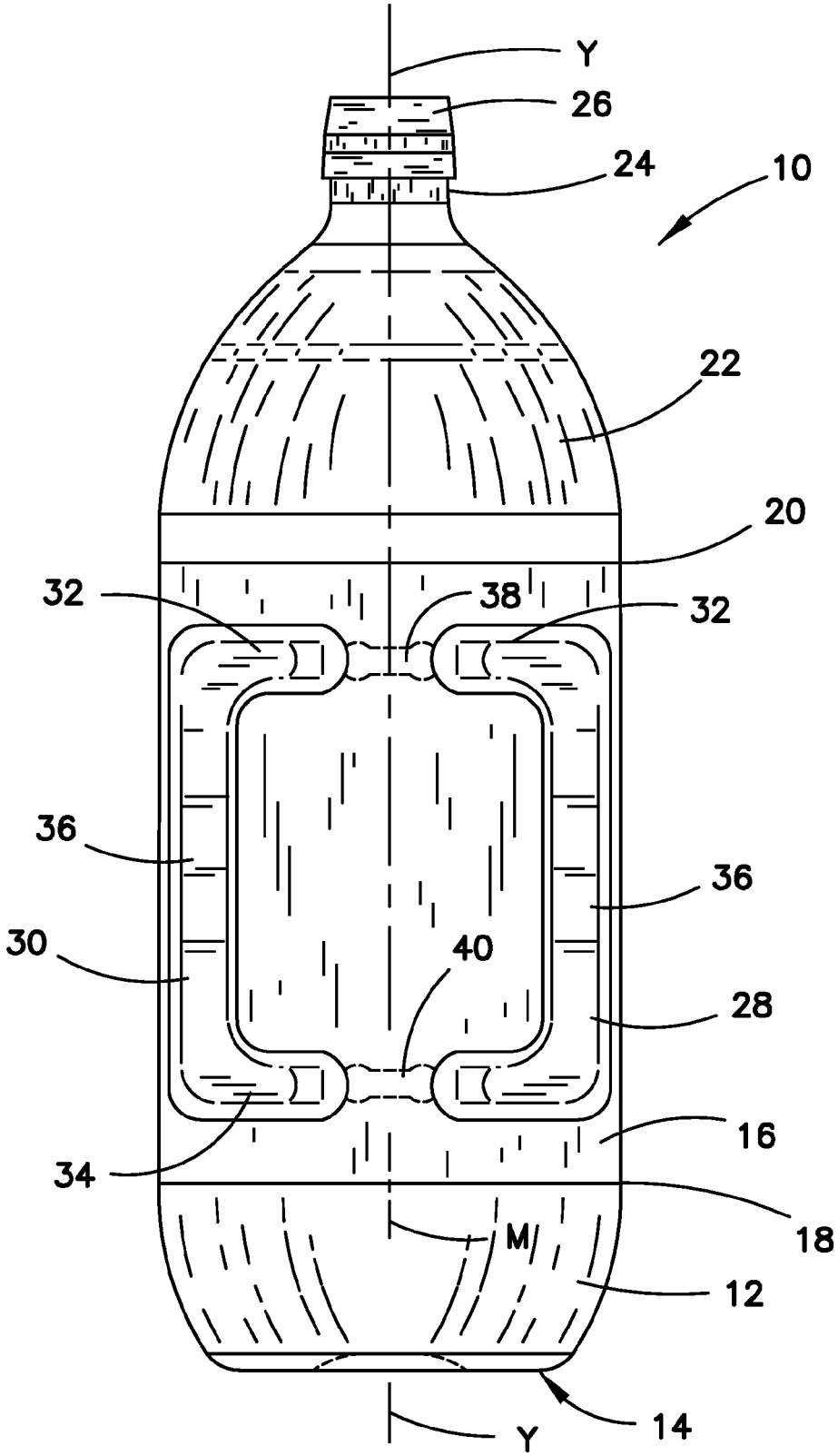
FIG. 1 is a front elevation view of a bottle including recesses adapted to receive handle portions.
Figure 2:
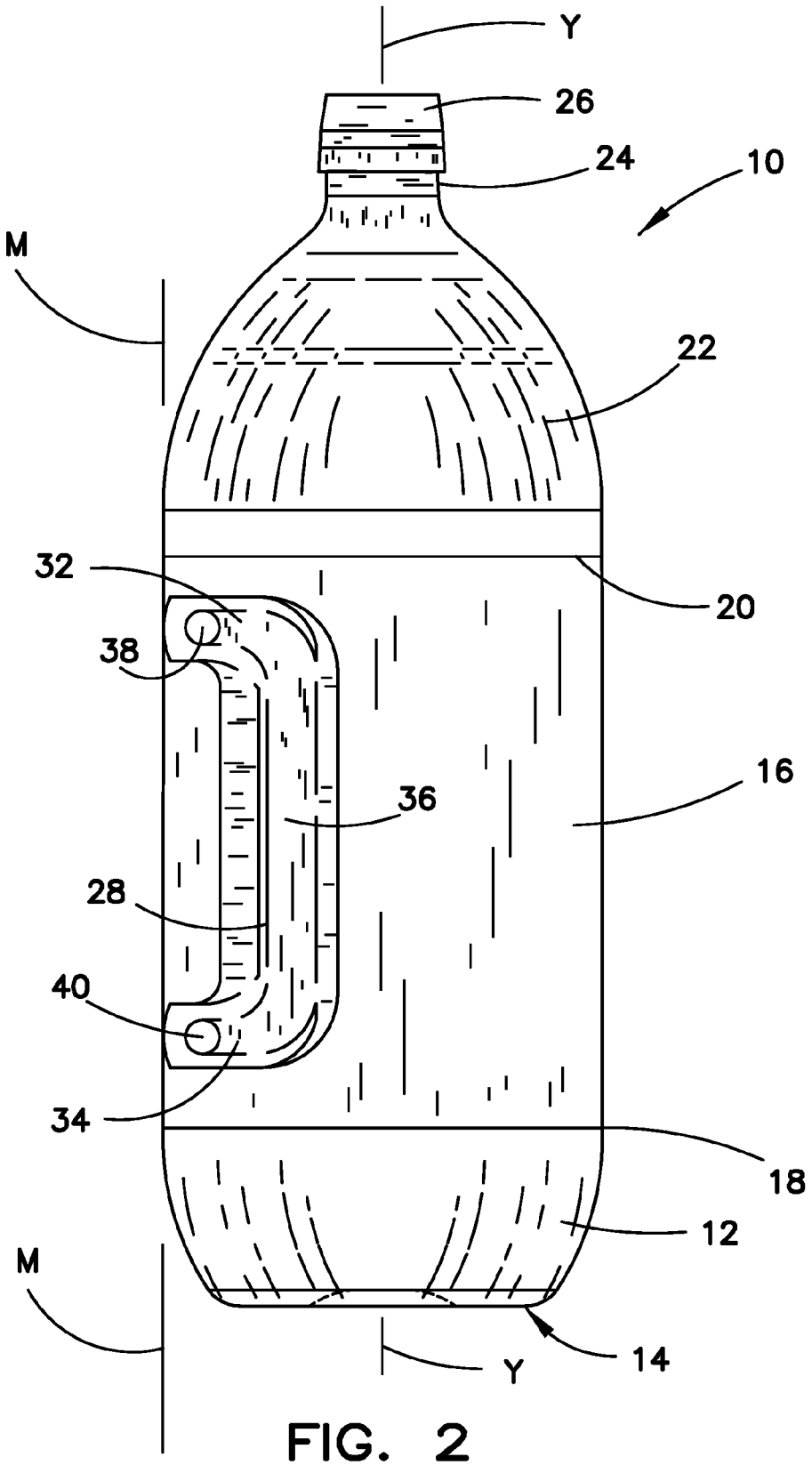
FIG. 2 is a side elevation view of the bottle of FIG. 1 showing a passage extending between the recesses.
Figure 3:
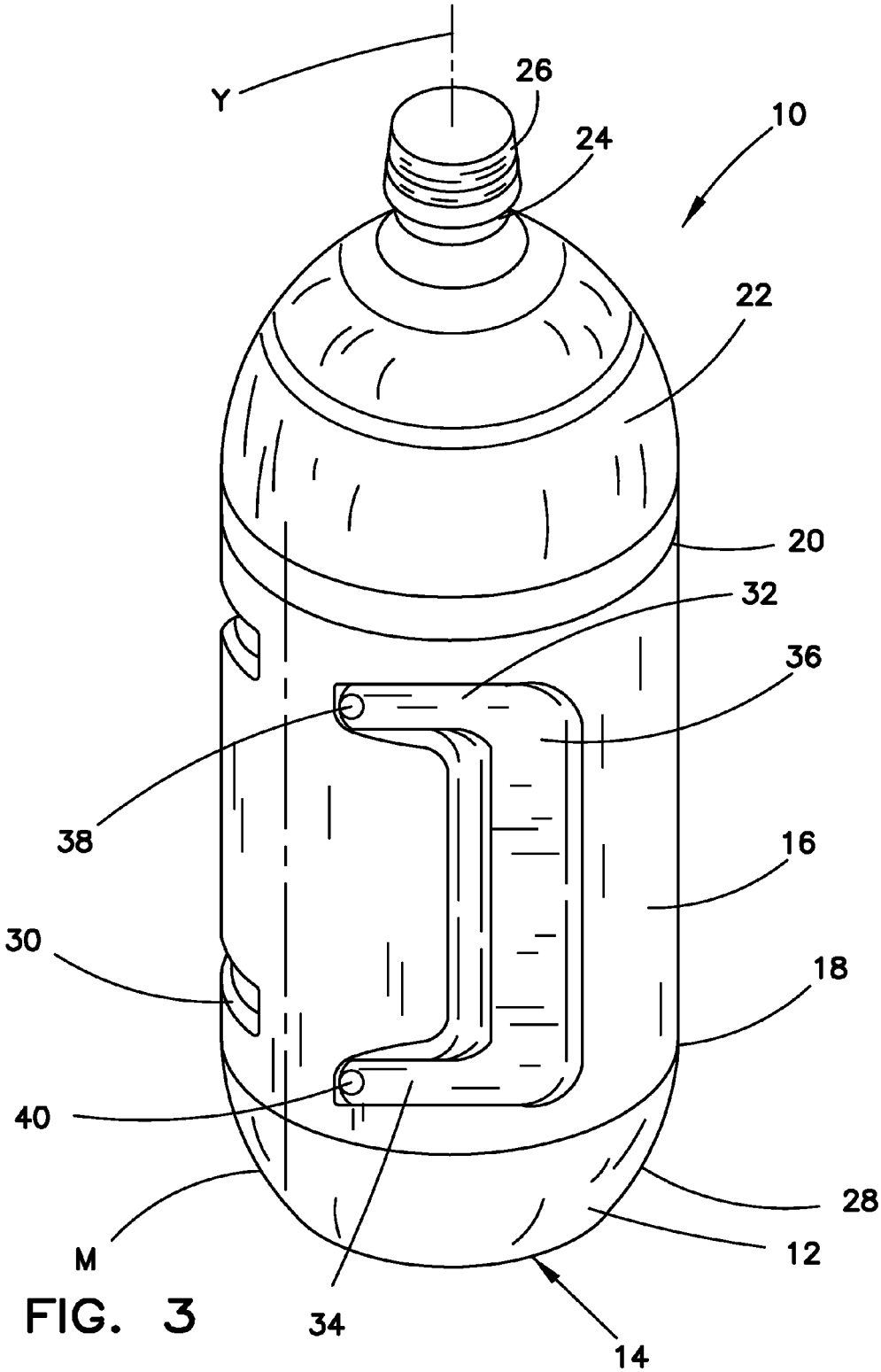
FIG. 3 is a perspective view of the bottle of FIGS. 1 and 2.

A bottle 10 is shown in FIGS. 1-3 that can be used in a container of the present invention. The bottle 10 can include a base 12. While the base 12 is illustrated to have an essentially planar bottom 14, the base 12 can be a petaloid bottom formed with a plurality of feet, or a champagne style bottom formed with a seating ring surrounding a centrally located, upwardly projected dome. A sidewall 16 can extend upward from the base 12. The sidewall 16 can include a lower margin 18 that is continuously joined to the base 12, and an upper margin 20. While the upper and lower margins 18 and 20 of sidewall 16 are shown to be circular, so that the sidewall is generally cylindrical, other shapes are also possible including triangular, ovate, rectangular, etc. A shoulder 22 can be continuously joined to the sidewall upper margin 20 to extend upward and inward from the sidewall 16 to a finish 24 surrounding an opening into the bottle 10. The finish 24 can be threaded or otherwise adapted to receive a closure 26. The bottle 10 can be formed of plastic, metal, glass and other materials.

The sidewall 16 can additionally include a pair of recesses 28, 30 situated on opposite sides of a midline M, which can be vertical and arranged parallel to an axis Y of the bottle 10. The recesses 28, 30 are shown to be indentations into the sidewall 16 including an upper leg 32, a lower leg 34 and a middle portion 36 forming a continuous trough in the sidewall 16. A passage 38 can extend between inner ends of the pair of upper legs 32 of the recesses 28, 30. Another passage 40 can extend between inner ends of the pair of lower legs 34 of the recesses 28, 30. The passages 38, 40 can be defined by inserts around which the bottle 10 is formed. The passages 38, 40 can be completely surrounded or only partially surrounded by the plastic or other material forming the sidewall 16 of the bottle 10. The volume of the bottle 10 can be selected over a range of volumes, but the utility of the container will become particularly apparent in bottles having a volume of 2 liters and greater.

Figure 4:
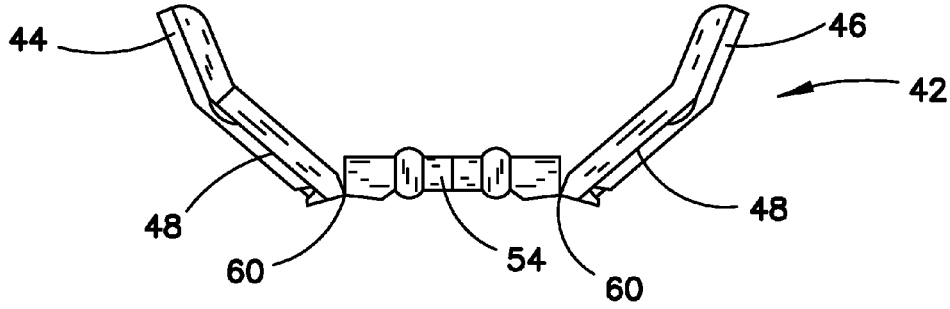
FIG. 4 is a top elevation view of a handle adapted to be coupled to the bottle of the previous FIGs.
Figure 5:
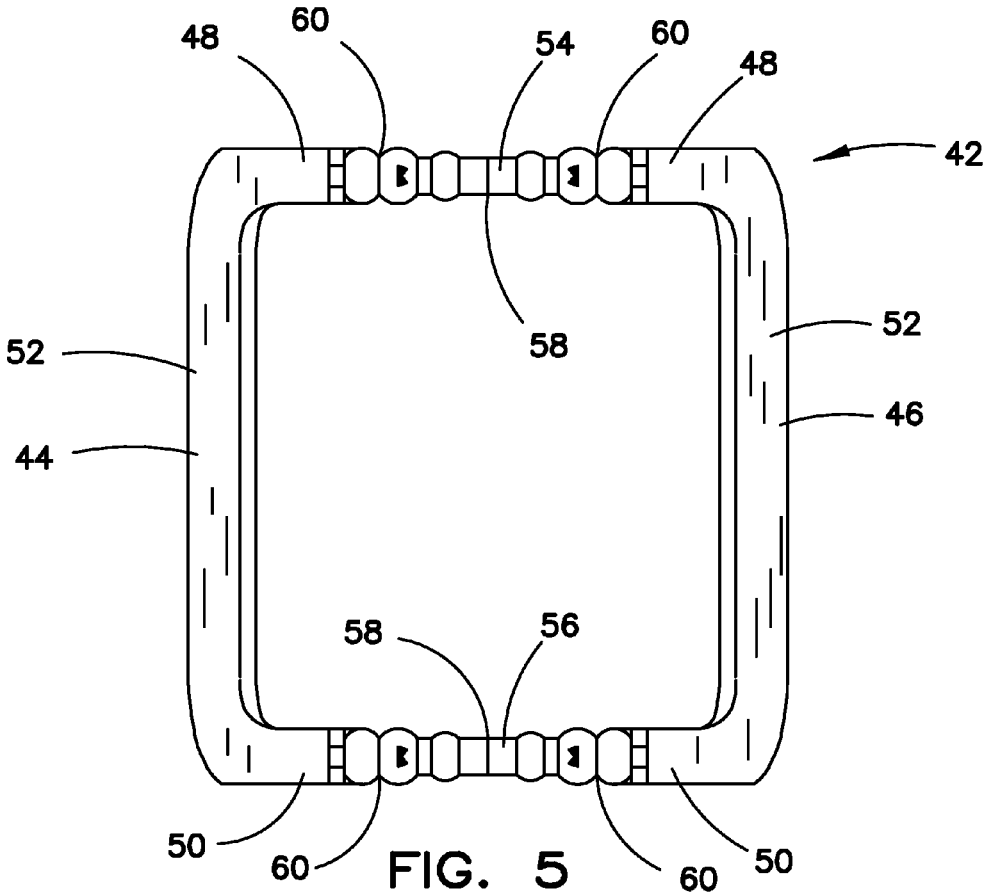
FIG. 5 is a front elevation view of a handle adapted to be coupled to the bottle of the previous FIGs.
Figure 6:
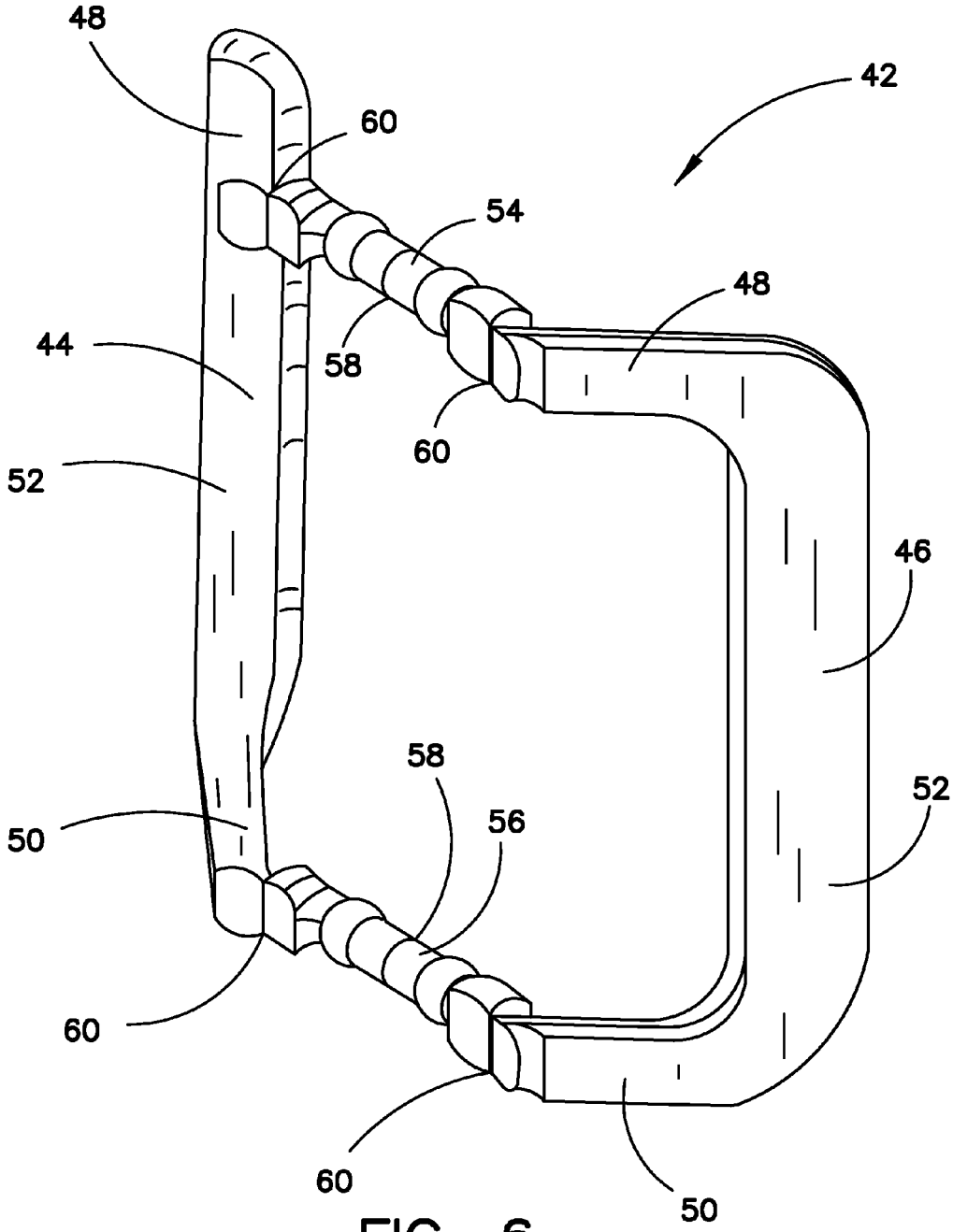
FIG. 6 is a perspective view of a handle adapted to be coupled to the bottle of the previous FIGs.
Figure 7:
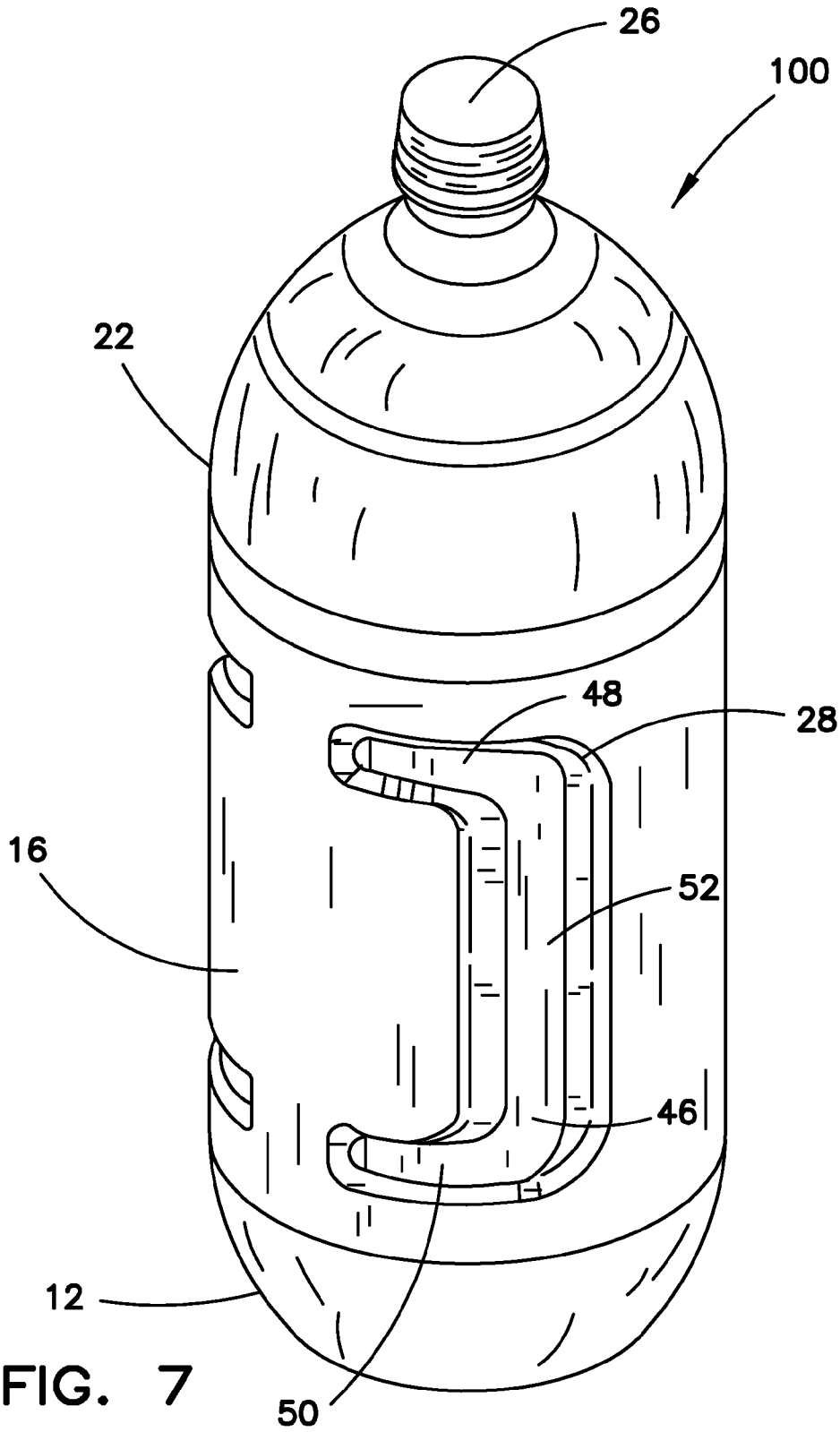
FIG. 7 is a perspective view of a container formed by the addition of the handle of FIGS. 4-6 to the bottle of FIGS. 1-3.
Figure 8:
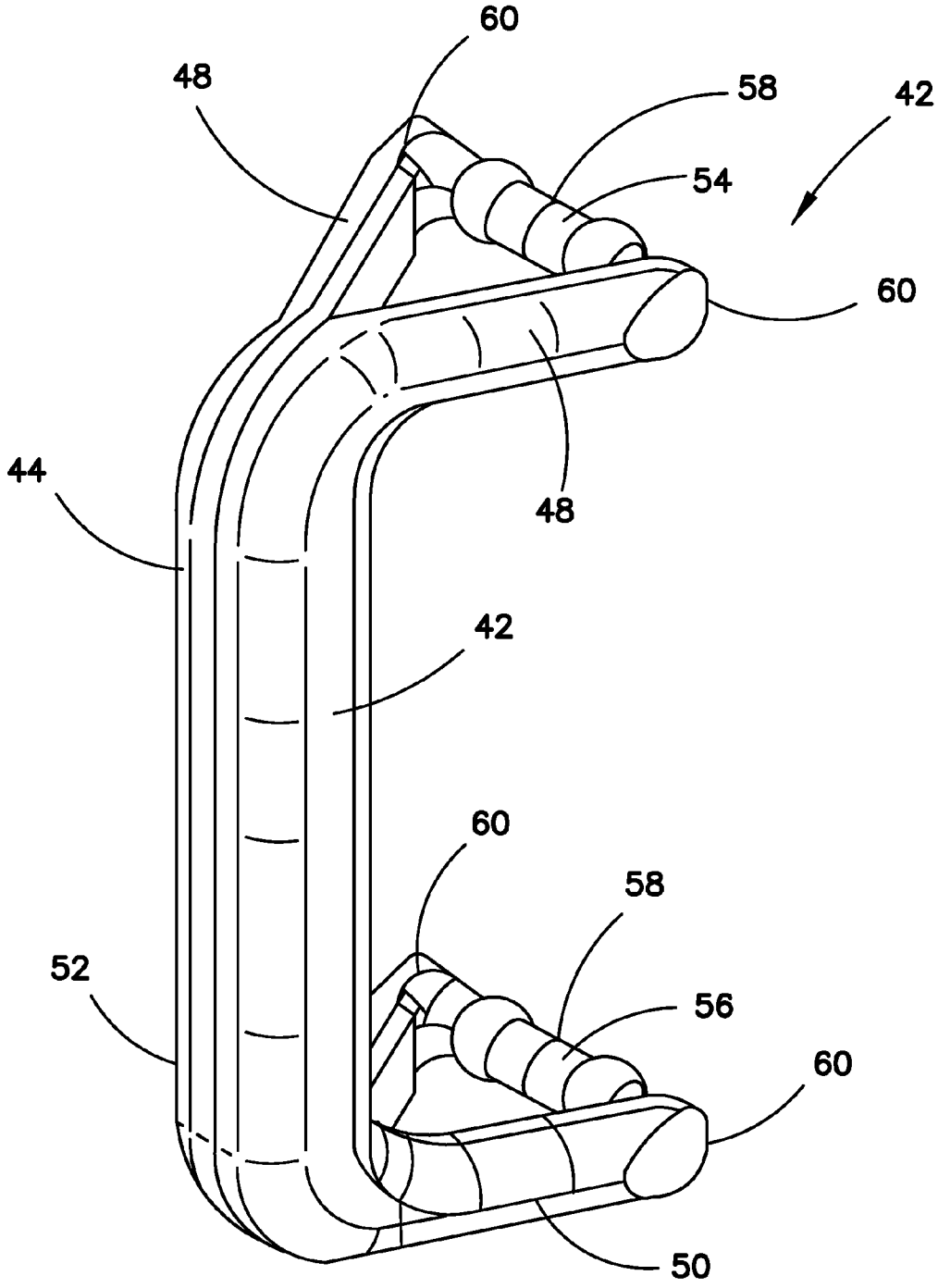
FIG. 8 is a perspective view of the handle adapted to be coupled to the bottle of the previous FIGs, the handle being folded along hinge lines to an outwardly projecting position.
Figure 9:
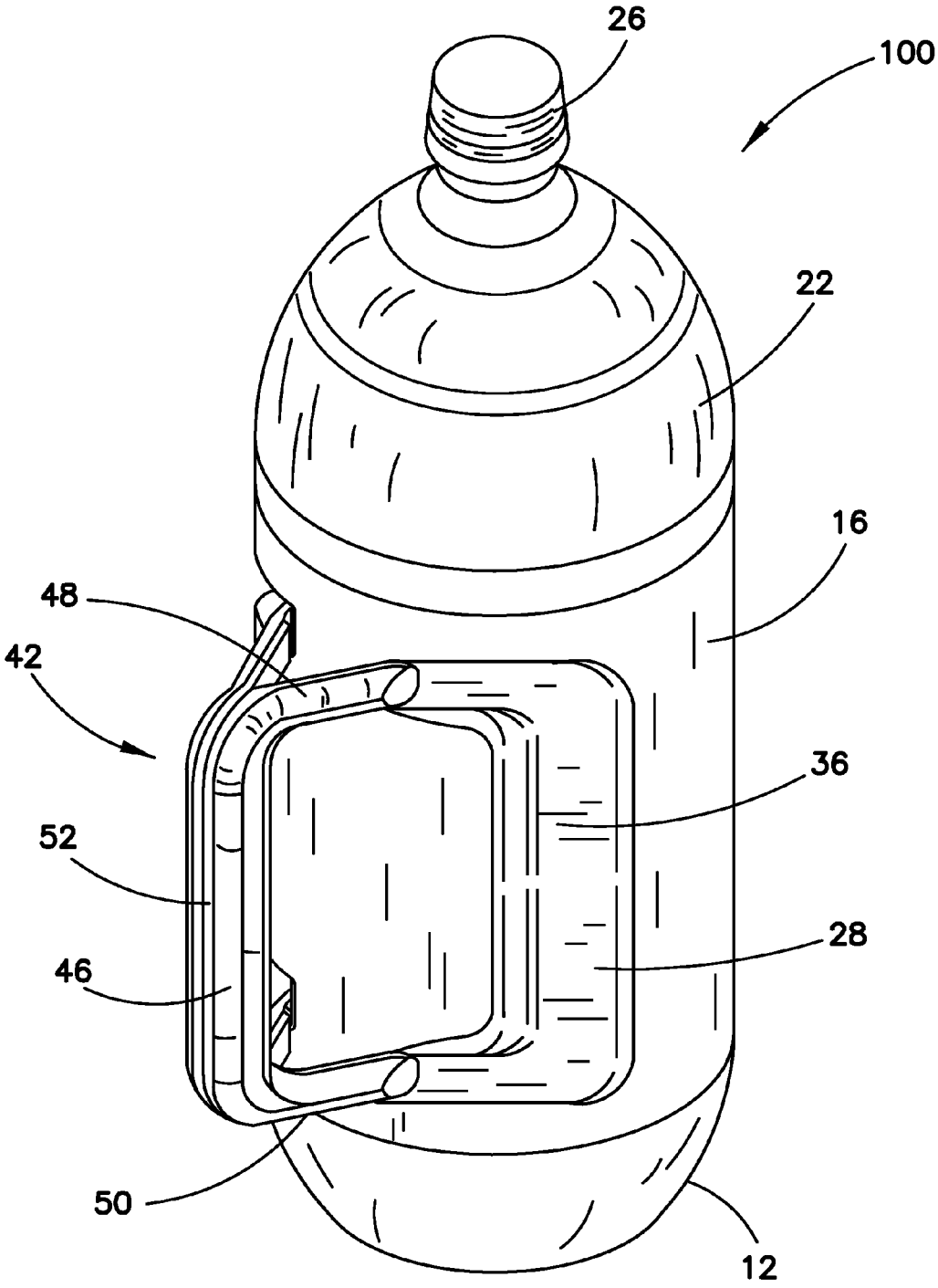
FIG. 9 is a perspective view similar to FIG. 7 with the handle folded to the outwardly projecting position.

A handle 42 is shown in FIGS. 4-6 that is suitable for use in conjunction with the bottle 10 to form a container of the present invention. The handle 42 can include a first portion 44 and second portion 46. The first and second portions 44, 46 can be suitably dimensioned to be received wholly within the pair of recesses 28, 30 in the sidewall 16 of bottle 10 as shown in FIG. 7 to form a container 100. The first and second portions 44, 46 can each include an upper portion 48, a lower portion 50, and a middle portion 52 that can join the upper and lower portions into a one-piece unitary formation. Connecting upper portions 54 can be provided to connect each of the adjoining upper portions 48. Likewise, lower connecting portions 56 can be provided to connect each of the adjoining lower portions 50. The connecting portions 54, 56 can include a separable junction 58 that will permit the connecting portions to extend through at least one of the passages 38, 40 to connect the first and second handle portions 44, 46 to each other. The connecting portions 54, 56 can include at least one hinge 60 permitting the first and second handle portions 44, 46 to be displaced from within the sidewall recesses 28, 30 of container 10, as shown in FIG. 7, to a projecting position as shown in FIGS. 8 and 9. The handle 42 is seen in FIG. 9 to project outward from the sidewall 16 sufficiently to permit the first and second portions 44, 46 to be grasped in one hand by a user of the container 10.

Figure 10:
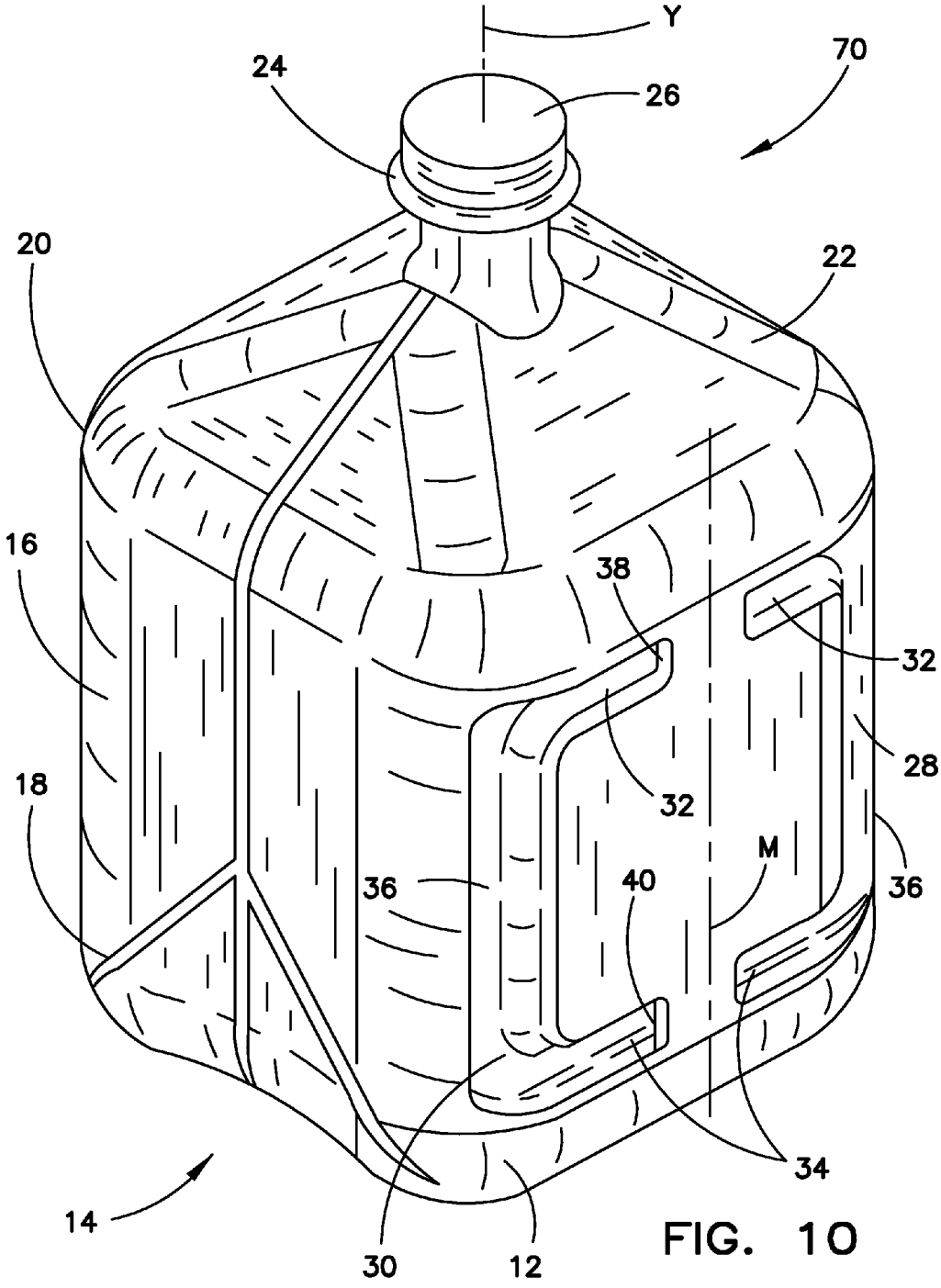
FIG. 10 is a perspective view of another bottle including recesses adapted to receive handle portions.
Figure 11:
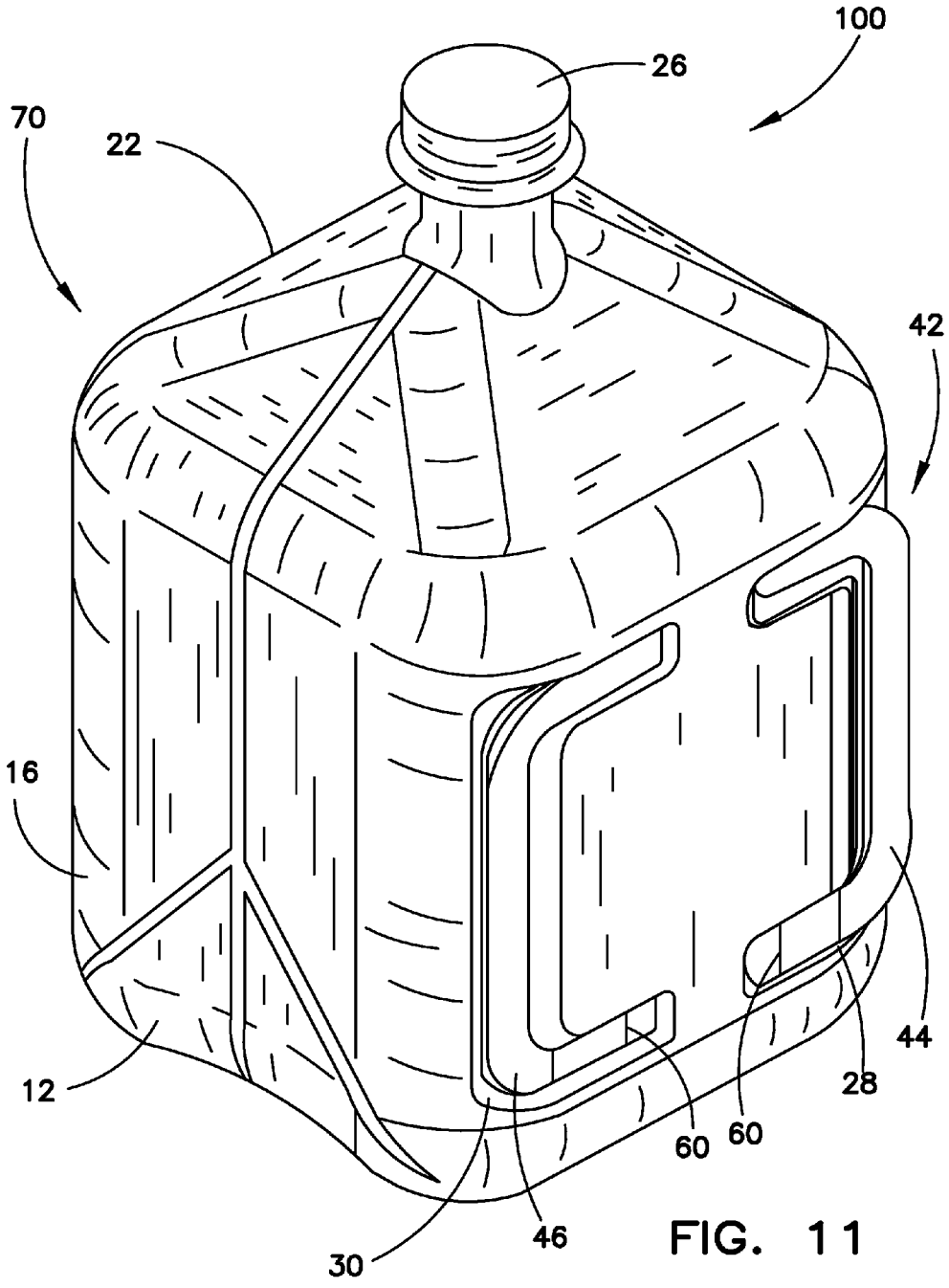
FIG. 11 is a perspective view of a container formed by the bottle of FIG. 10 and a handle similar to that shown in FIG. 4-6.
Figure 12:
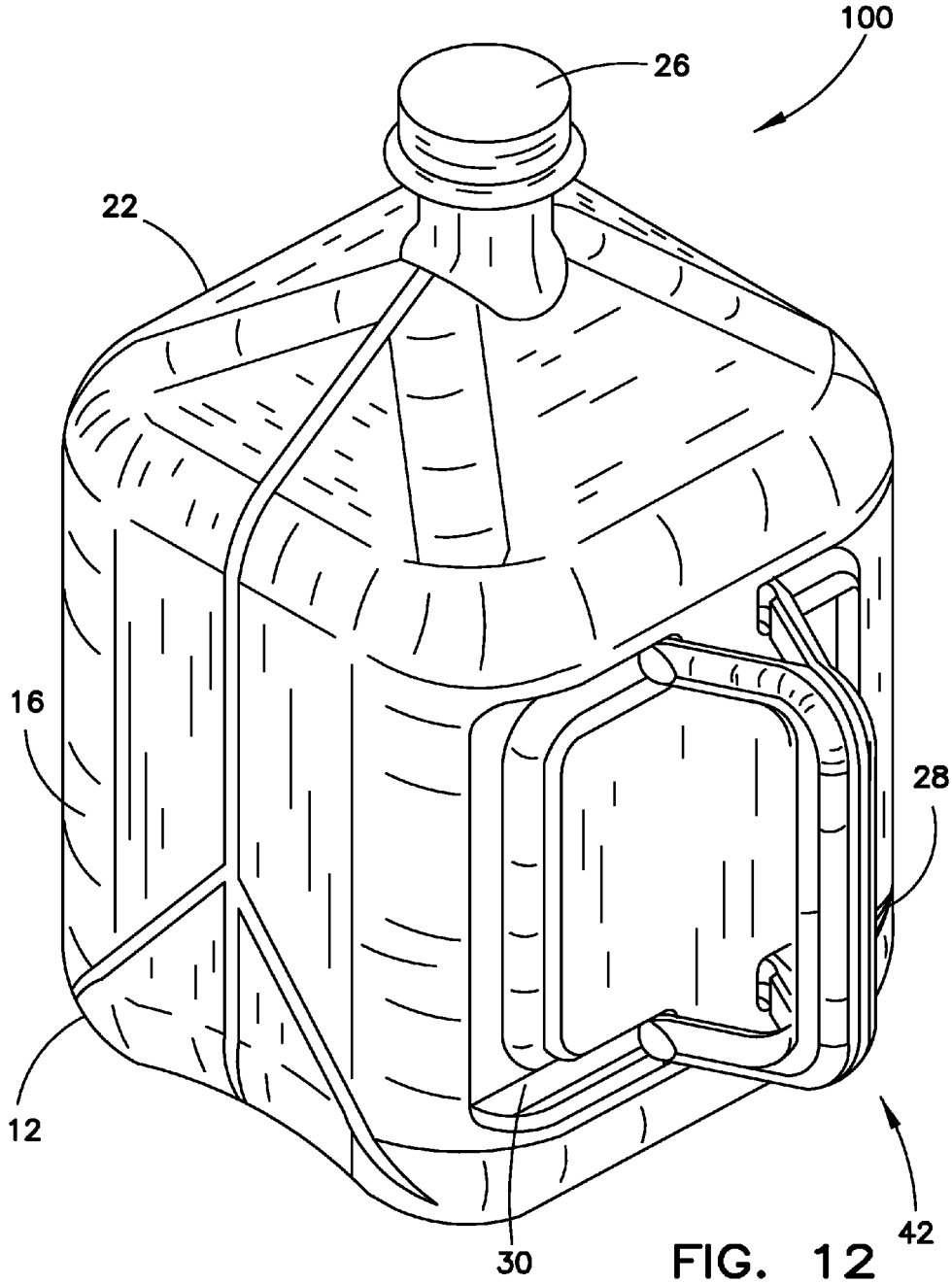
FIG. 12 is a perspective view of the container of FIG. 11 with the handle folded to the outwardly projecting position.

Another embodiment of a container 100 is shown in FIGS. 10-12, wherein the bottle 70 can include a base 12. A sidewall 16 can extend upward from the base 12. The sidewall 16 can include a lower margin 18 that is continuously joined to the base 12, and an upper margin 20. A shoulder 22 can be continuously joined to the sidewall upper margin 20 to extend upward and inward from the sidewall 16 to a finish 24 surrounding an opening into the bottle 70. The finish 24 can be threaded or otherwise adapted to receive a closure 26. The bottle 100 can be formed of plastic, metal, glass and other materials.

The sidewall 16 can additionally include a pair of recesses 28, 30 situated on opposite sides of a midline M, which can be vertical and arranged parallel to an axis Y of the bottle 70. The recesses 28, 30 are shown to be indentations into the sidewall 16 including an upper leg 32, a lower leg 34 and a middle portion 36 forming a continuous trough in the sidewall 16. A passage 38 can extend between inner ends of the pair of upper legs 32 of the recesses 28, 30. Another passage 40 can extend between inner ends of the pair of lower legs 34 of the recesses 28, 30. The passages 38, 40 can be defined by inserts around which the bottle 70 is formed. The passages 38, 40 can be completely surrounded or only partially surrounded by the plastic or other material forming the sidewall 16 of the bottle 70. When the bottle 70 is formed by an extrusion-blow molding process of polymers adapted to such processing, the passages 38, 40 between the pair of recesses 28, 30 can be formed by a pinch-mold portion that defines a seam surrounding the passage generally in alignment with the mid-line M between the recesses 28, 30.

A handle 42 similar to that shown in FIGS. 4-6 and that is suitable for use in conjunction with the bottle 70 can be used to form a container 100 as shown in FIGS. 11 and 12. The first and second portions 44, 46 of handle 42 can be suitably dimensioned to be received wholly within the pair of recesses 28, 30 in the sidewall 16 of bottle 70 as shown in FIG. 11. The handle 42 can include at least one hinge 60 permitting the first and second handle portions 44, 46 to be displaced from within the sidewall recesses 28, 30 of container 100, as shown in FIG. 11, to a projecting position as shown in FIG. 12. The handle 42 is seen in FIG. 12 to project outward from the sidewall 16 sufficiently to permit the first and second portions 44, 46 to be grasped in one hand by a user of the container 100.

Figure 13:
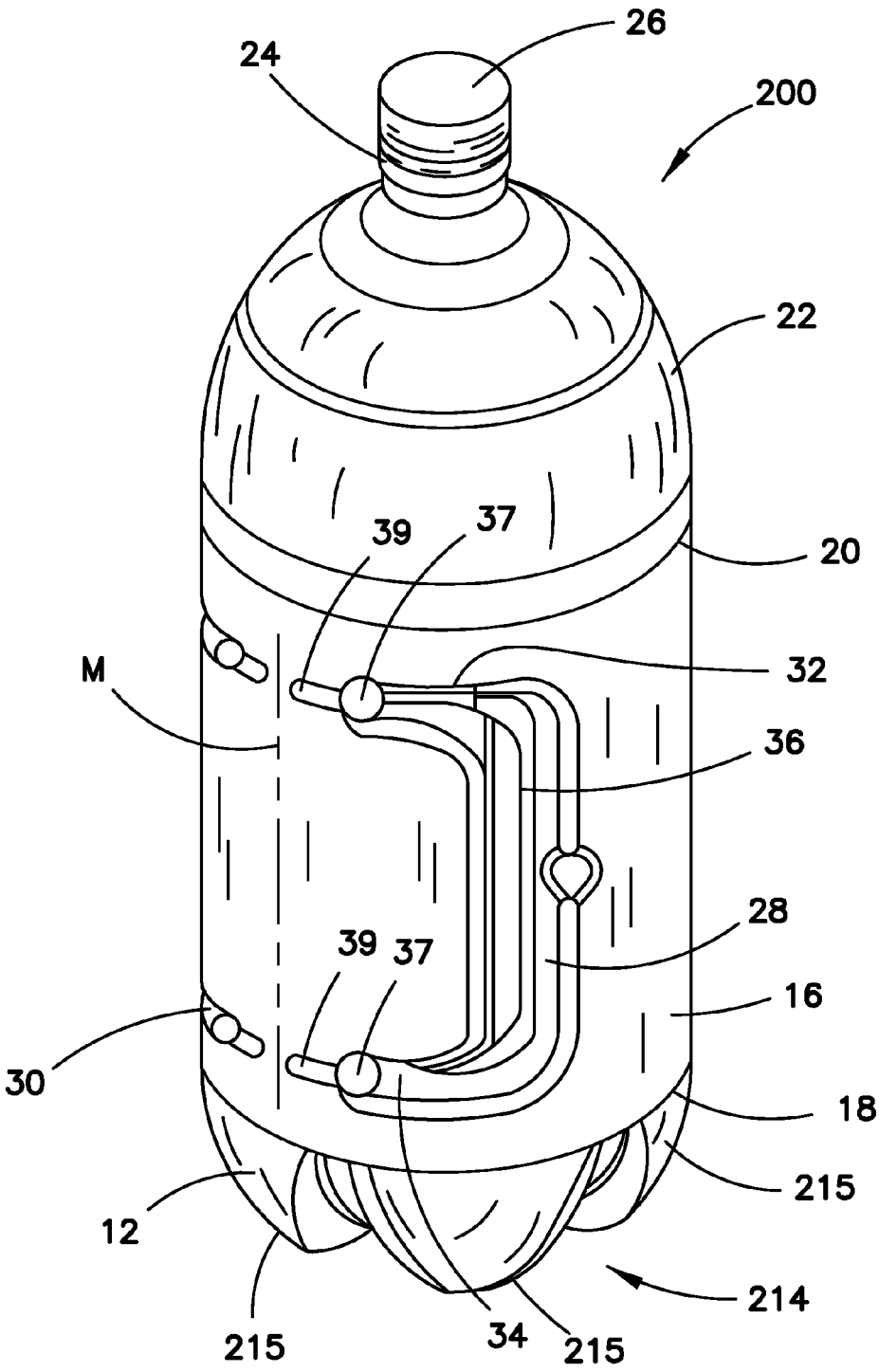
FIG. 13 is a perspective view of another bottle including recesses adapted to receive another style of handle portions.
Figure 16:
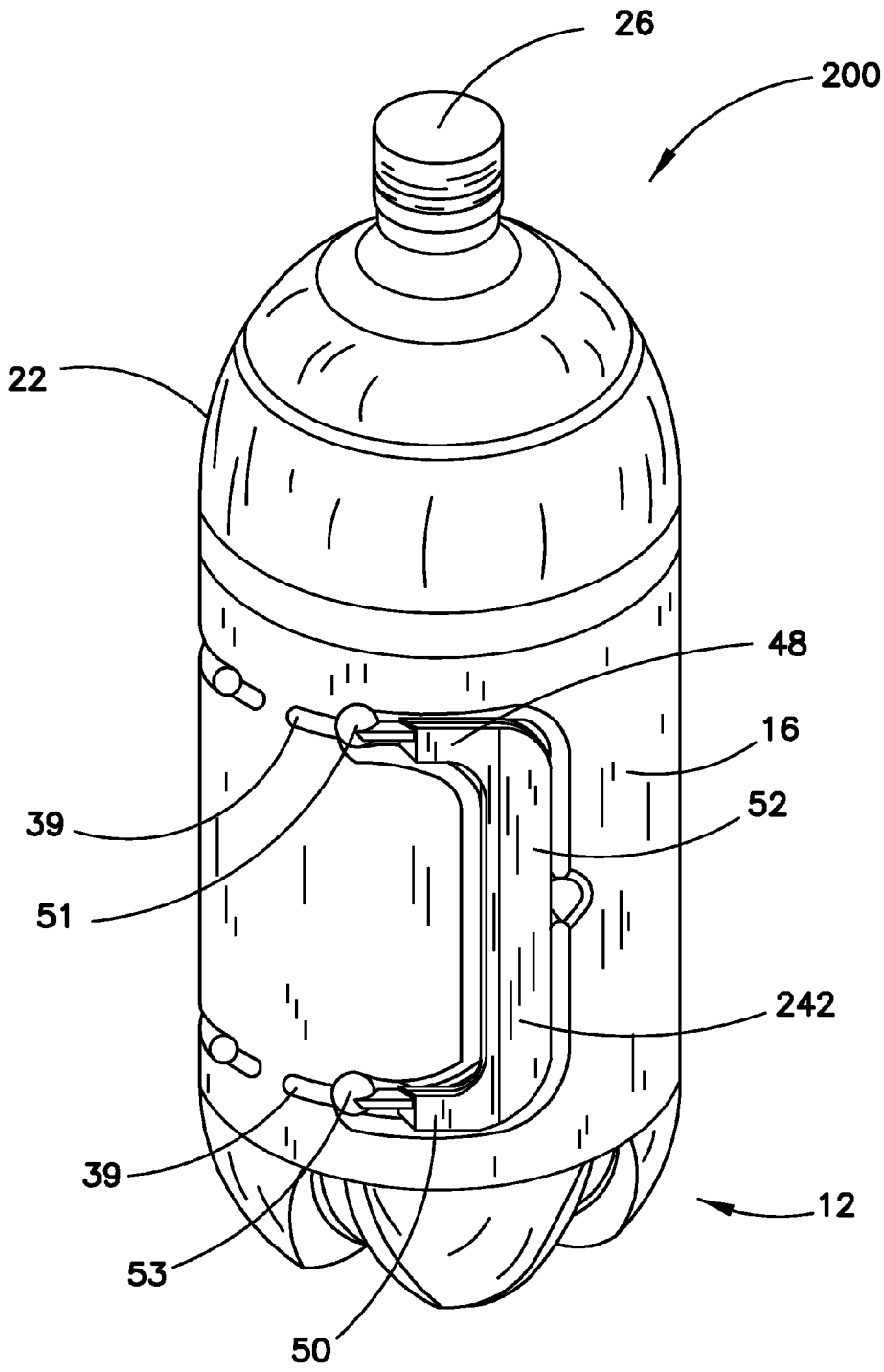
FIG. 16 is a perspective view of the bottle shown in FIG. 13 with the handles positioned within the sidewall recesses.
Figure 17:
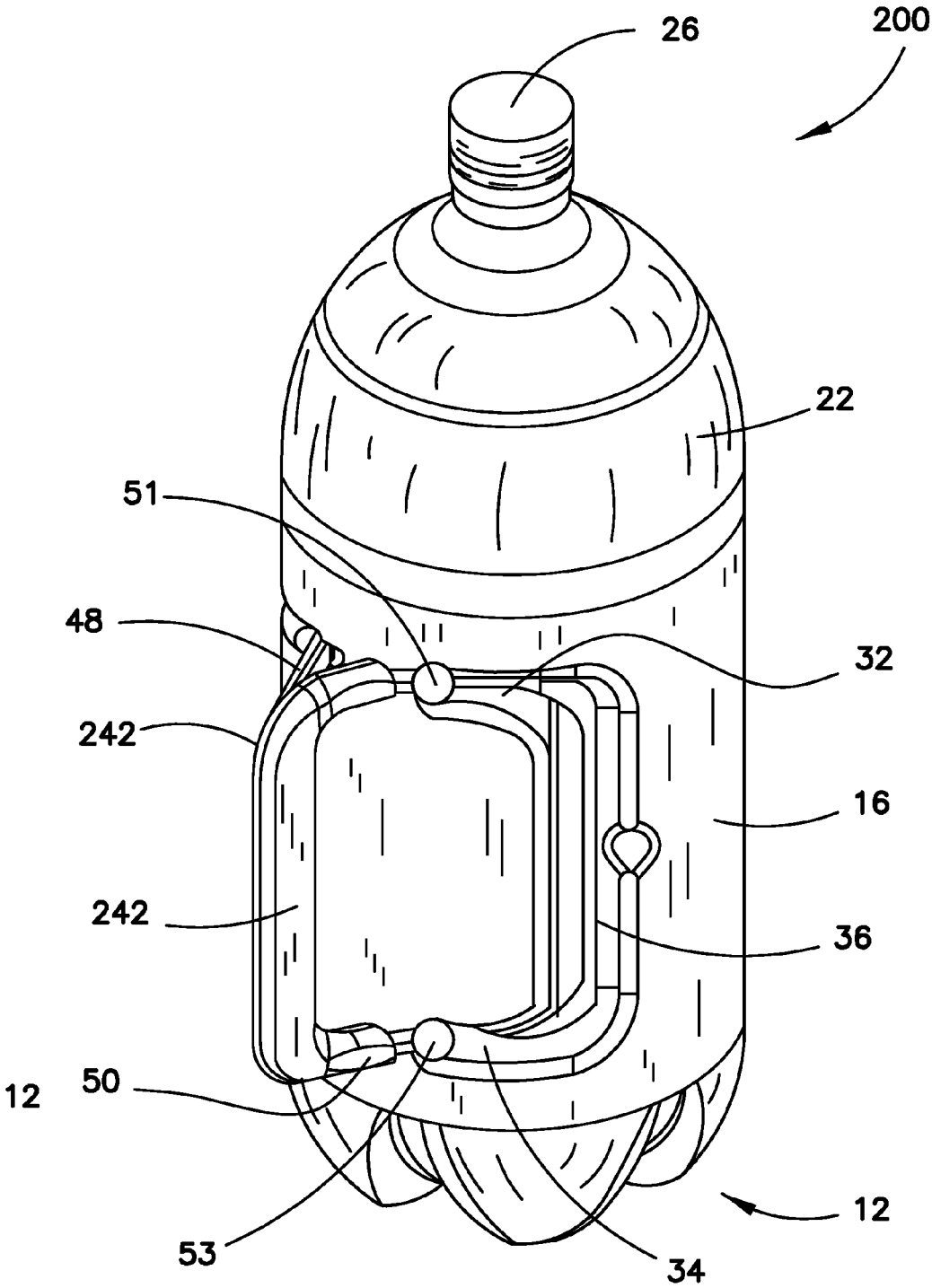
FIG. 17 is a perspective view of the bottle shown in FIG. 13 with the handles extending outward from the sidewall recesses.

Another bottle 200 is shown in FIGS. 13, 16 and 17. The bottle 200 can include a base 12. While the base 12 is illustrated to have a petaloid bottom 214 formed with a plurality of feet 215, the base 12 can be planar or a champagne style bottom formed with a seating ring surrounding a centrally located, upwardly projected dome as shown for bottle 10. A sidewall 16 can extend upward from the base 12. The sidewall 16 can include a lower margin 18 that is continuously joined to the base 12, and an upper margin 20. While the upper and lower margins 18 and 20 of sidewall 16 are shown to be circular, so that the sidewall is generally cylindrical, other shapes are also possible including triangular, ovate, rectangular, etc. A shoulder 22 can be continuously joined to the sidewall upper margin 20 to extend upward and inward from the sidewall 16 to a finish 24 surrounding an opening into the bottle 10. The finish 24 can be threaded or otherwise adapted to receive a closure 26. The bottle 200 can be formed of plastic, metal, glass and other materials.

The sidewall 16 can additionally include a pair of recesses 28, 30 situated on opposite sides of a midline M, which can be vertical and arranged parallel to an axis Y of the bottle 200. The recesses 28, 30 are shown to be indentations into the sidewall 16 including an upper leg 32, a lower leg 34 and a middle portion 36 forming a continuous trough in the sidewall 16. A socket 37 is provided at the end of the upper leg 32 and the lower leg 34 nearest to the midline M. A wedge-shaped slot 39 can extend from each of the sockets 37 toward the midline M. The volume of the bottle 200 can be selected over a range of volumes, but the utility of the container will become particularly apparent in bottles having a volume of 2 liters and greater.

Figure 14:
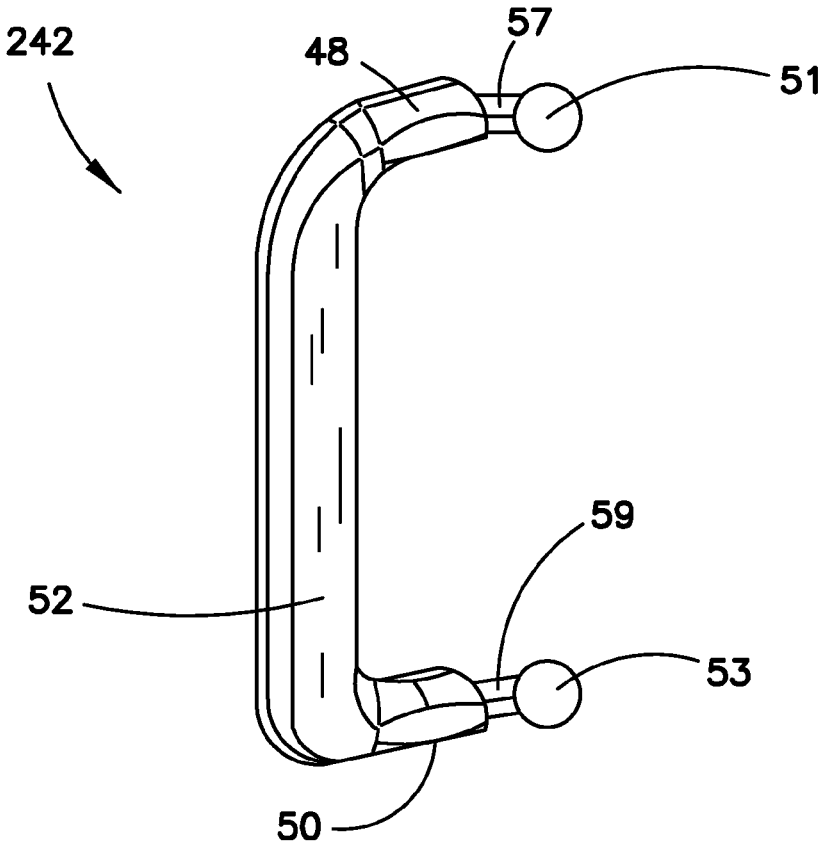
FIG. 14 is a perspective view of one of the handles adapted to be received by the bottle of FIG. 13.
Figure 15:
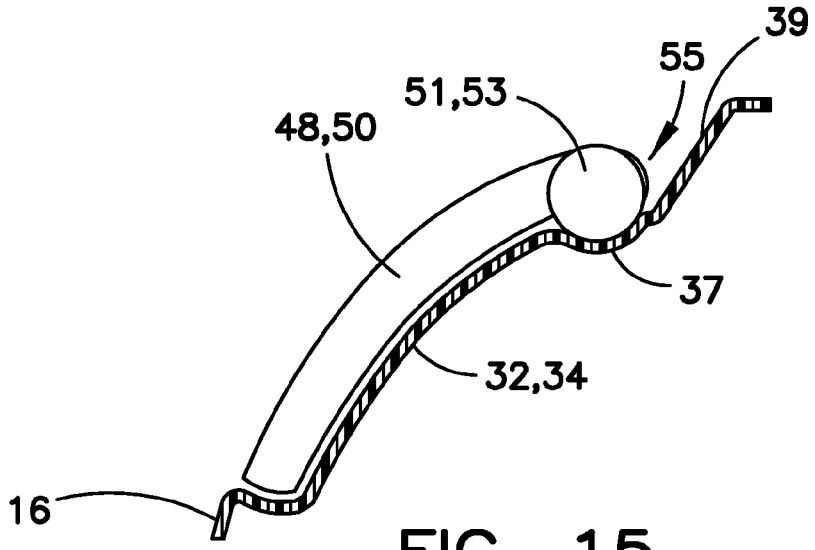
FIG. 15 is an elevation detail view of the ball portion of the handle shown in FIG. 14 in a socket adjacent the inner end of a bottle recess, shown in section.

A handle 242 is shown in FIGS. 14 and 15 that is suitable for use in conjunction with the bottle 200 to form a container of the present invention. A pair of handles 242 can be suitably dimensioned to be received wholly within the pair of recesses 28, 30 in the sidewall 16 of bottle 200. Each handle 242 can each include an upper portion 48, a lower portion 50, and a middle portion 52 that can join the upper and lower portions into a one-piece unitary formation. A ball shaped end 51 and 53 can be connected to the upper portion 48, and the lower portion 50, respectively, by web portions 57 and 59. The ball shaped ends 51 and 53 can be received in the sockets 37 at the inner ends of sidewall recesses 28 and 30 so that the handles 242 can be wholly received within the recesses 28, 30 as shown in FIG. 16. The ball shaped ends 51 and 53 permit the handles to be displaced from the recessed position shown in FIG. 16 to a projecting position as shown in FIG. 17. This displacement causes the web portions 57 and 59 to enter into slots 39 so that the middle portions 52 of the handles 242 are sufficiently close to each other to permit the handles 242 to be grasped in one hand by a user of the container 200.

The ball shaped ends 51 and 53 can be spherical, but at least one of the ball shaped ends 51 and 53 can be non-spherical so as to include a projecting portion 55 as shown in FIG. 15. The projecting portion 55 can interact with the adjacent socket 37 so as to provide a detent biasing the handles 242 toward either a fully retained or a fully projecting position. This biasing of the handles toward the fully retained position acts to inhibit accidental projection of the handles 242 during transport of the bottles 200. The biasing of the handles toward the fully projecting position acts to ensure that the middle portions 52 of the handles 242 are sufficiently close to each other to permit the handles 242 to be grasped in one hand by a user of the container 200.

Figure 18:
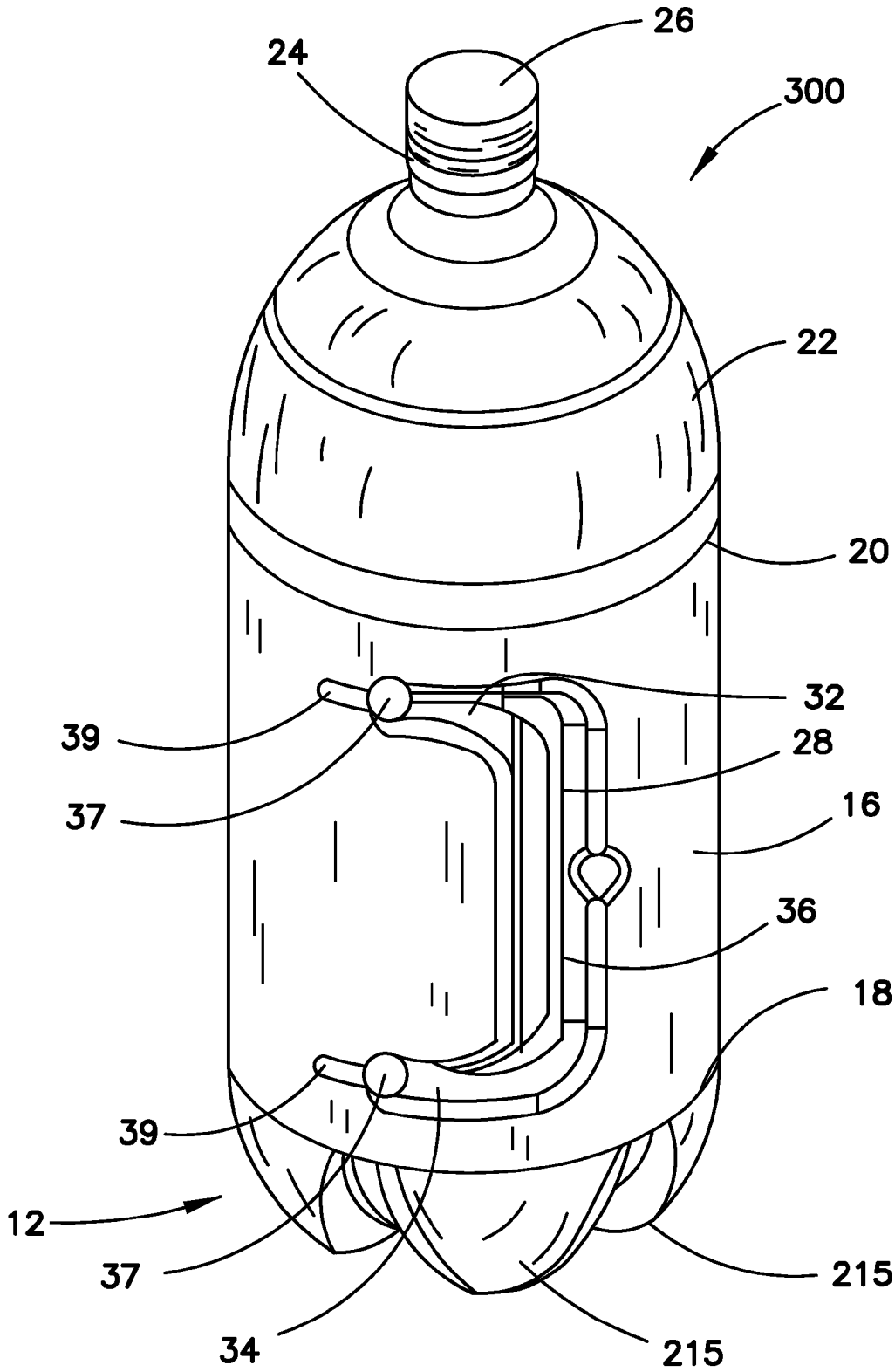
FIG. 18 is a perspective view of a bottle similar to FIG. 13, but having only a single recess to receive a handle generally of the type shown in FIGS. 14 and 15.
Figure 19:
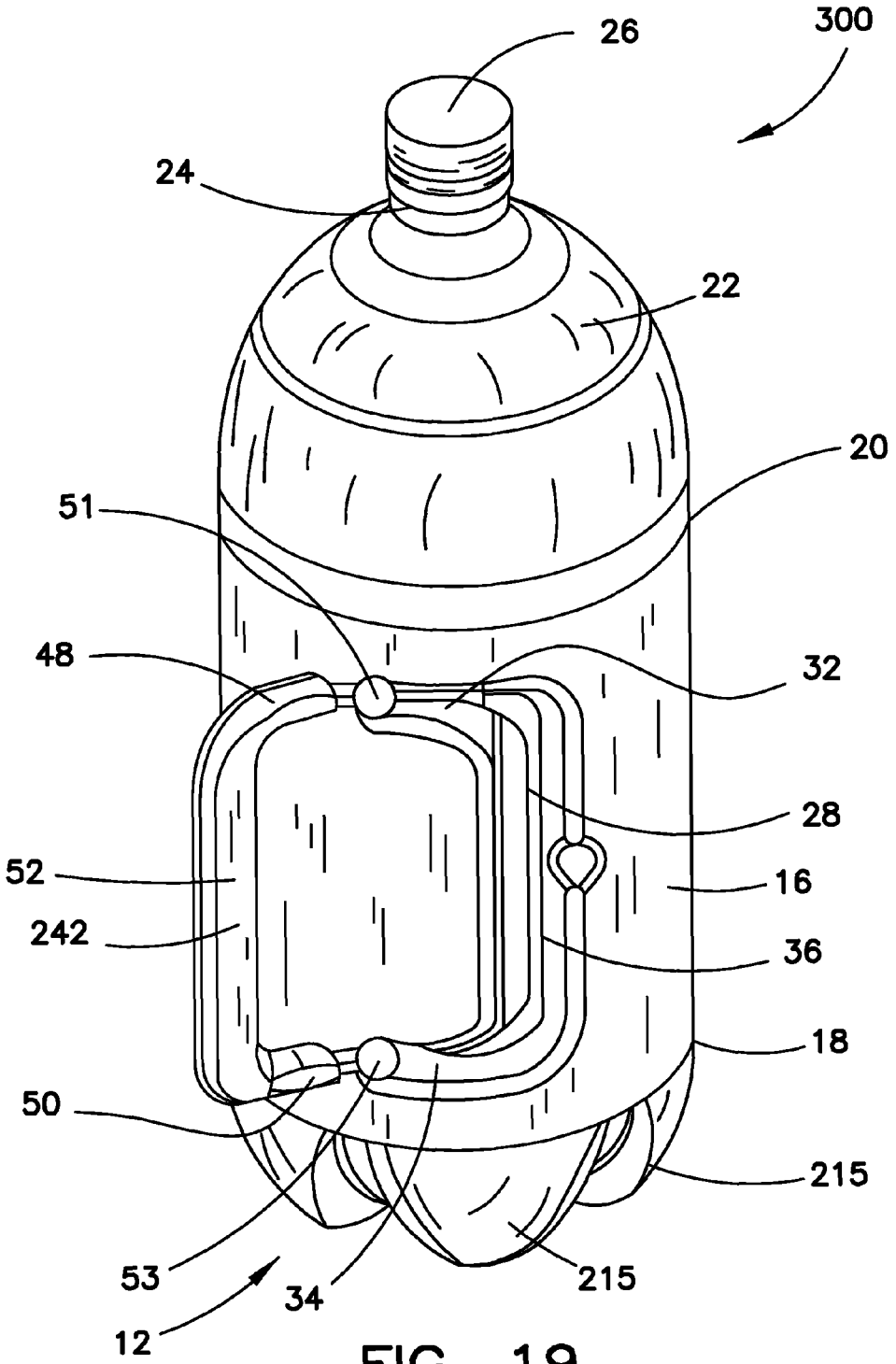
FIG. 19 is a perspective view of the bottle shown in FIG. 18 with the handle extending outward from the sidewall recess.

While FIGS. 13, 16 and 17 depict a container 200 having a pair of handles 242, it may be appropriate in certain circumstances to employ a container 300 having only a single handle 242 received in a single slot 36 as shown in FIGS. 18 and 19. The bottle 300 can include a base 12, illustrated to have a petaloid bottom 214 formed with a plurality of feet 215. A sidewall 16 can extend upward from the base 12. The sidewall 16 can include a lower margin 18 that is continuously joined to the base 12, and an upper margin 20. While the upper and lower margins 18 and 20 of sidewall 16 are shown to be circular, so that the sidewall is generally cylindrical, other shapes are also possible including triangular, ovate, rectangular, etc. A shoulder 22 can be continuously joined to the sidewall upper margin 20 to extend upward and inward from the sidewall 16 to a finish 24 surrounding an opening into the bottle 10. The finish 24 can be threaded or otherwise adapted to receive a closure 26. The bottle 300 can be formed of plastic, metal, glass and other materials.

The sidewall 16 of bottle 300 is shown to include only a single recess 28. The recess 28 takes the form of an indentation into the sidewall 16 including an upper leg 32, a lower leg 34 and a middle portion 36 forming a continuous trough in the sidewall 16. A socket 37 is provided at the end of the upper leg 32 and the lower leg 34. A wedge-shaped slot 39 can extend laterally from each of the sockets 37 opposite the upper and lower leg portions 32, 34. The volume of the bottle 300 can be selected over a range of volumes, but the utility of the container will become particularly apparent in bottles having a volume of 1 liter to 2 liters.

The handle 242 shown in FIGS. 14 and 15 is suitable for use in conjunction with the bottle 300 to form a container of the present invention. The handle 242 can be suitably dimensioned to be received wholly within the single recess 28 in the sidewall 16 of bottle 300. The handle 242 can include an upper portion 48, a lower portion 50, and a middle portion 52 that can join the upper and lower portions into a one-piece unitary formation. A ball shaped end 51 and 53 can be connected to the upper portion 48, and the lower portion 50, respectively, by web portions 57 and 59. The ball shaped ends 51 and 53 can be received in the sockets 37 in the sidewall recess 28 shown in FIG. 18 so that the handle 242 can be wholly received within the recess 28. The ball shaped ends 51 and 53 permit the handle 242 to be displaced from the recessed position to a projecting position as shown in FIG. 19. This displacement causes the web portions 57 and 59 to enter into slots 39 so that the middle portion 52 of the handle 242 can grasped in one hand by a user of the container 300.

Figure 20:
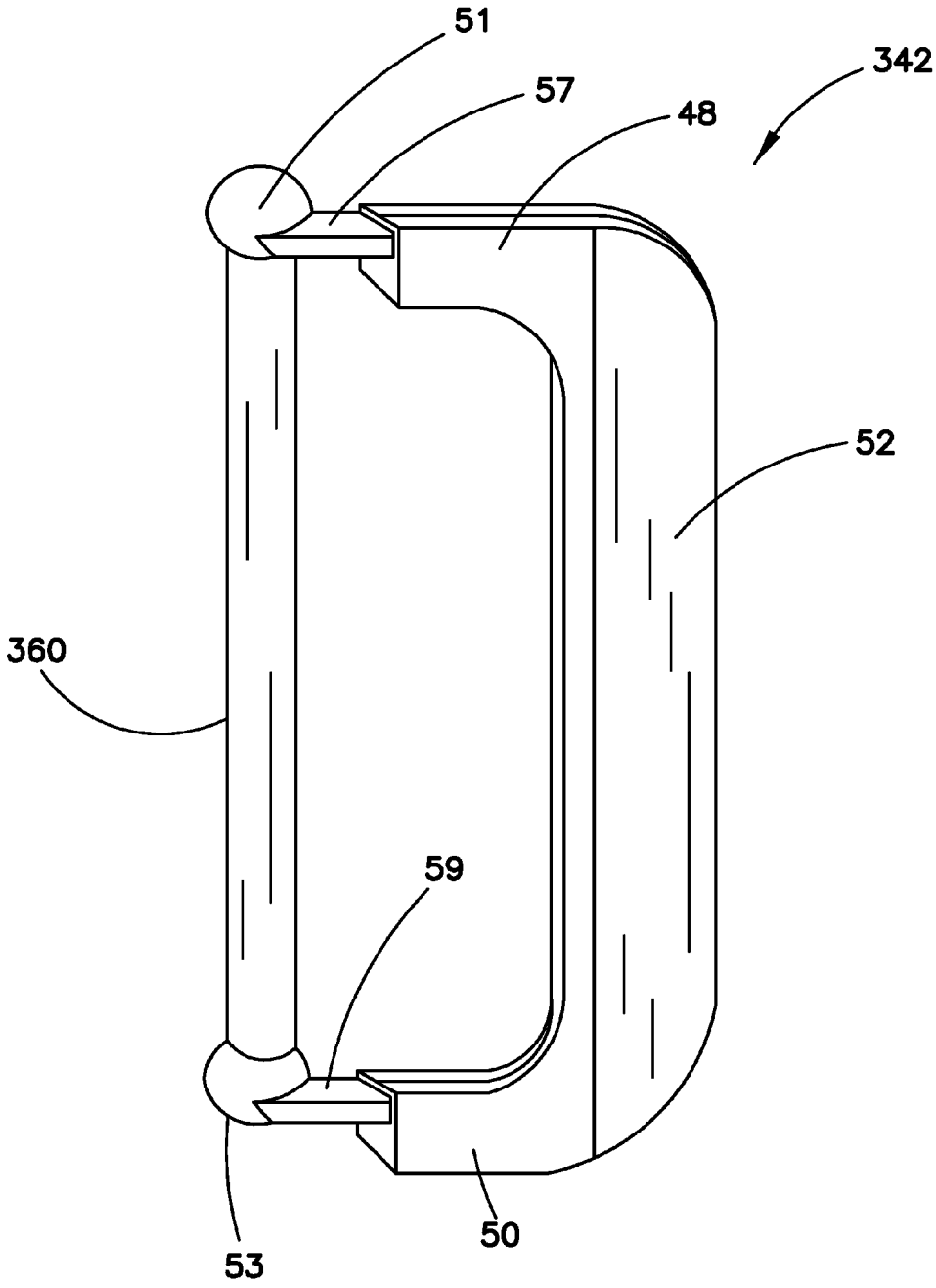
FIG. 20 is a perspective view of an alternative handle.
Figure 21:
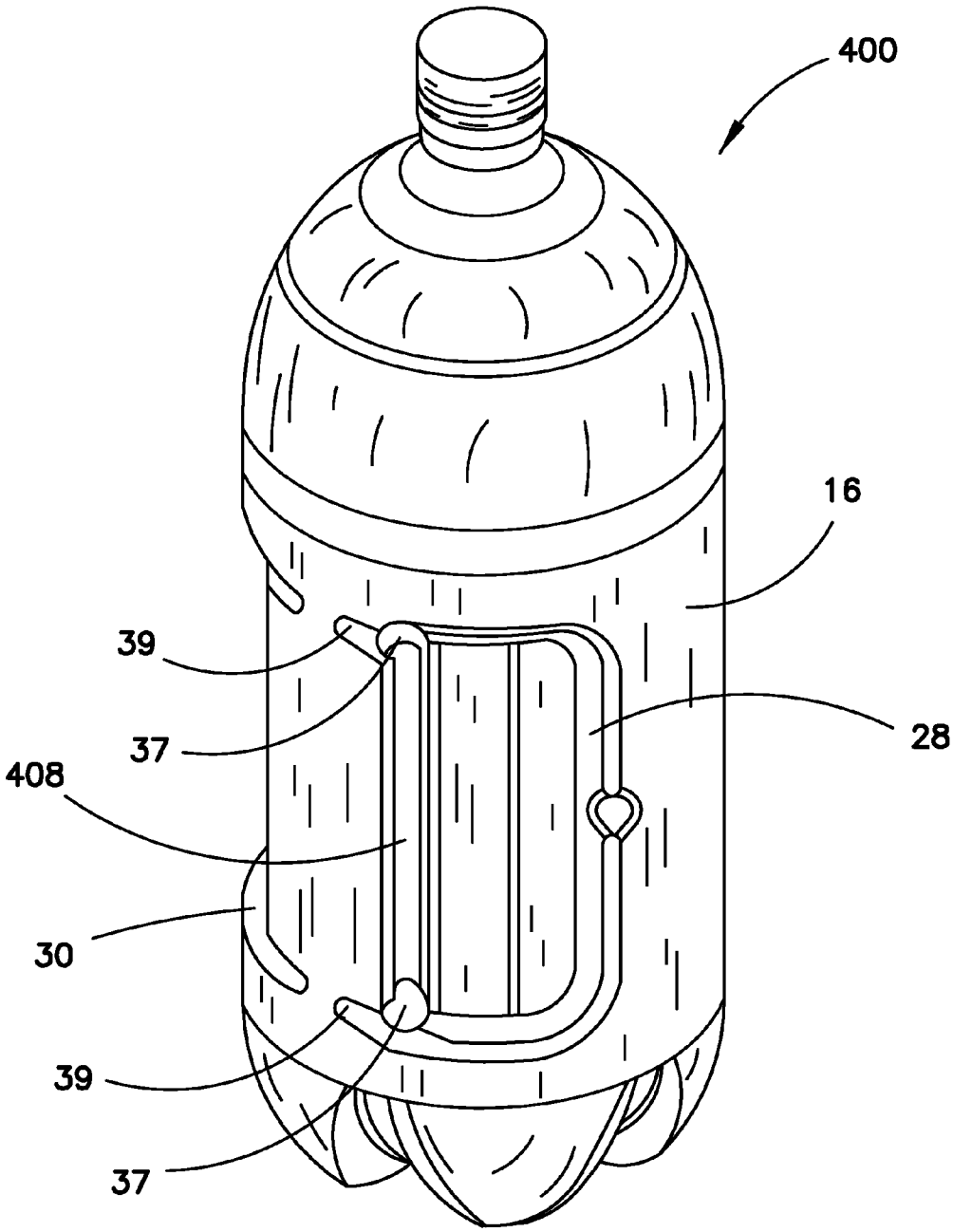
FIG. 21 is a perspective view of another bottle including recesses adapted to receive the handle shown in FIG. 20.
Figure 22:
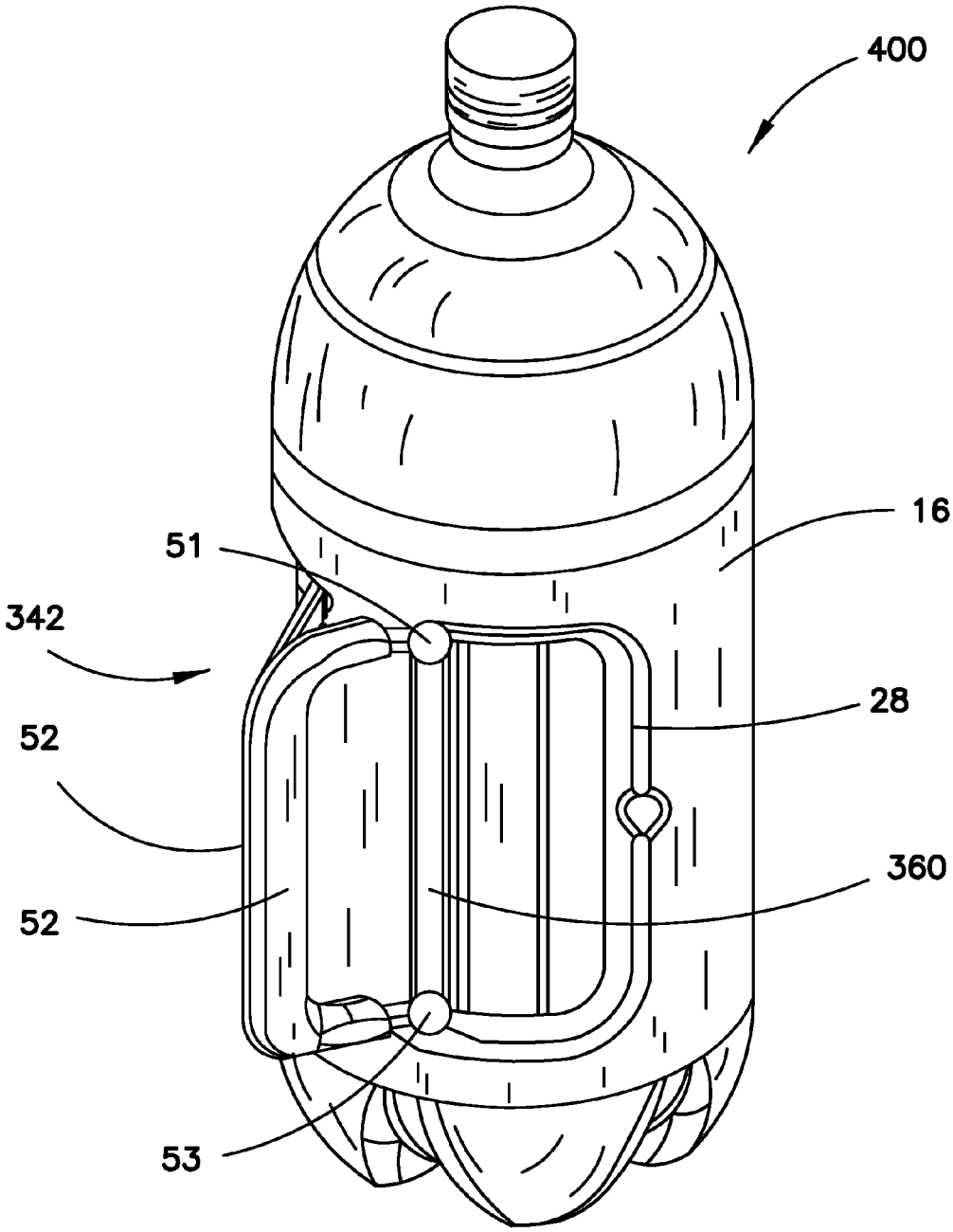
FIG. 22 is a perspective view of the bottle shown in FIG. 21 with the handles extending outward from the sidewall recesses.

Another alternative handle 342 is shown in FIG. 20. The handle 342 shown in FIG. 20 is suitable for use in conjunction with a bottle 400 shown in FIGS. 21 and 22 to form a container of the present invention. The bottle 400 can be formed of plastic, metal, glass and other materials. A pair of handles 342 can be suitably dimensioned to be received wholly within the pair of recesses 28, 30 in the sidewall 16 of bottle 400. Each handle 342 can each include an upper portion 48, a lower portion 50, and a middle portion 52 that can join the upper and lower portions into a one-piece unitary formation. A ball shaped end 51 and 53 can be connected to the upper portion 48, and the lower portion 50, respectively, by web portions 57 and 59. A pintle member 360 can extend vertically between the ball shaped ends 51 and 53. The ball shaped ends 51 and 53 can be received in the sockets 37 at the inner ends of sidewall recesses 28 and 30. The pintle member 360 can be received in vertical slots 408 in the sidewall 16 of bottle 400 so that the handles 342 can be wholly received within the recesses 28, 30. The ball shaped ends 51 and 53 permit the handles to be displaced from the recessed position to a projecting position as shown in FIG. 22. This displacement causes the web portions 57 and 59 to enter into slots 39 so that the middle portions 52 of the handles 342 are sufficiently close to each other to permit the handles 342 to be grasped in one hand by a user of the container 400.

The ball shaped ends 51 and 53 of handles 342 can be spherical, but at least one of the ball shaped ends 51 and 53 can be non-spherical so as to include a projecting portion 55 as shown in FIG. 15. The projecting portion 55 can interact with the adjacent socket 37 so as to provide a detent biasing the handles 342 toward either a fully retained or a fully projecting position. This biasing of the handles toward the fully retained position acts to inhibit accidental projection of the handles 342 during transport of the bottles 400. The biasing of the handles toward the fully projecting position acts to ensure that the middle portions 52 of the handles 342 are sufficiently close to each other to permit the handles 342 to be grasped in one hand by a user of the container 400.

Figure 23:
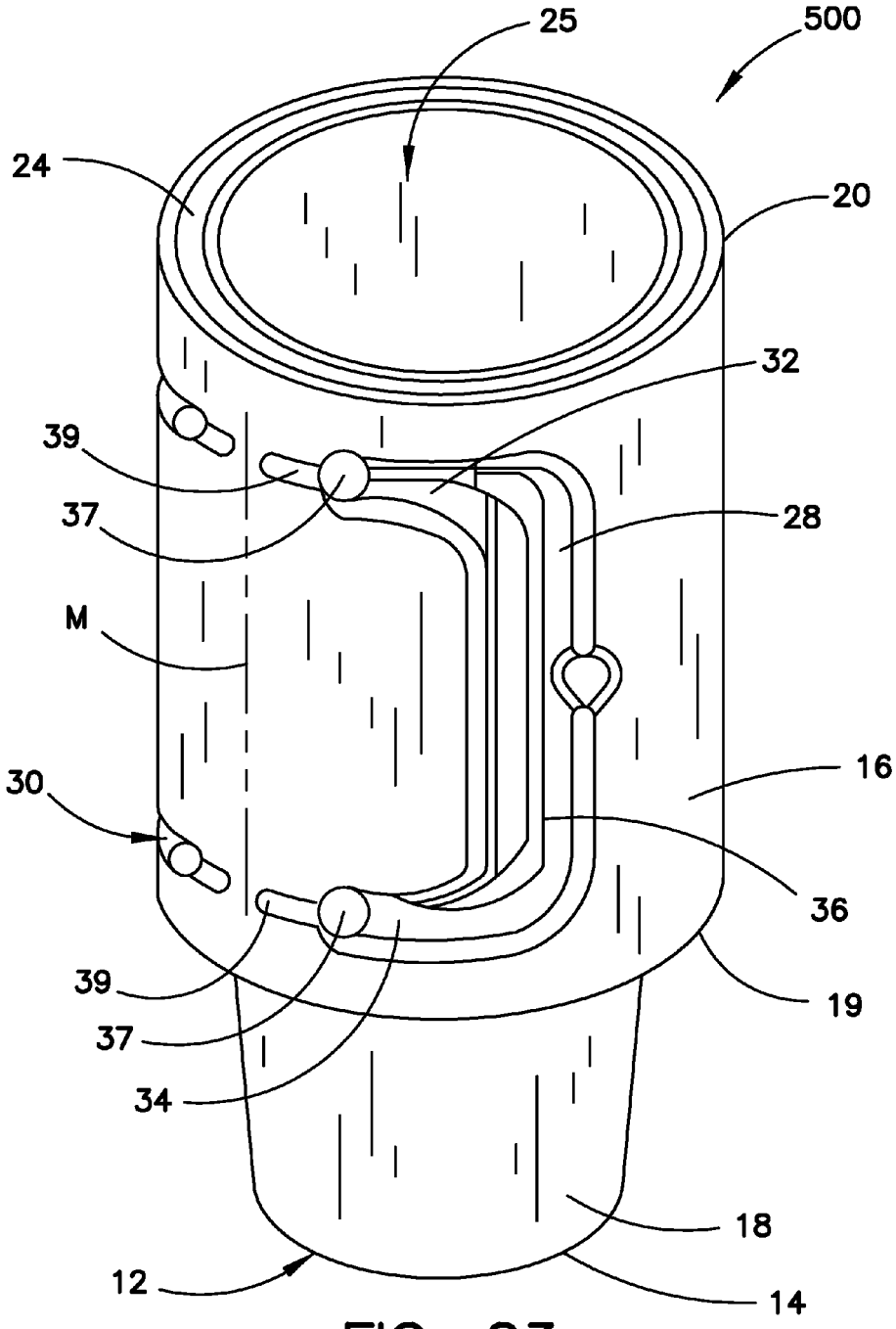
FIG. 23 is a perspective view a coffee mug or similar article including recesses adapted to receive the handle shown in FIGS. 14 and 15.
Figure 24:
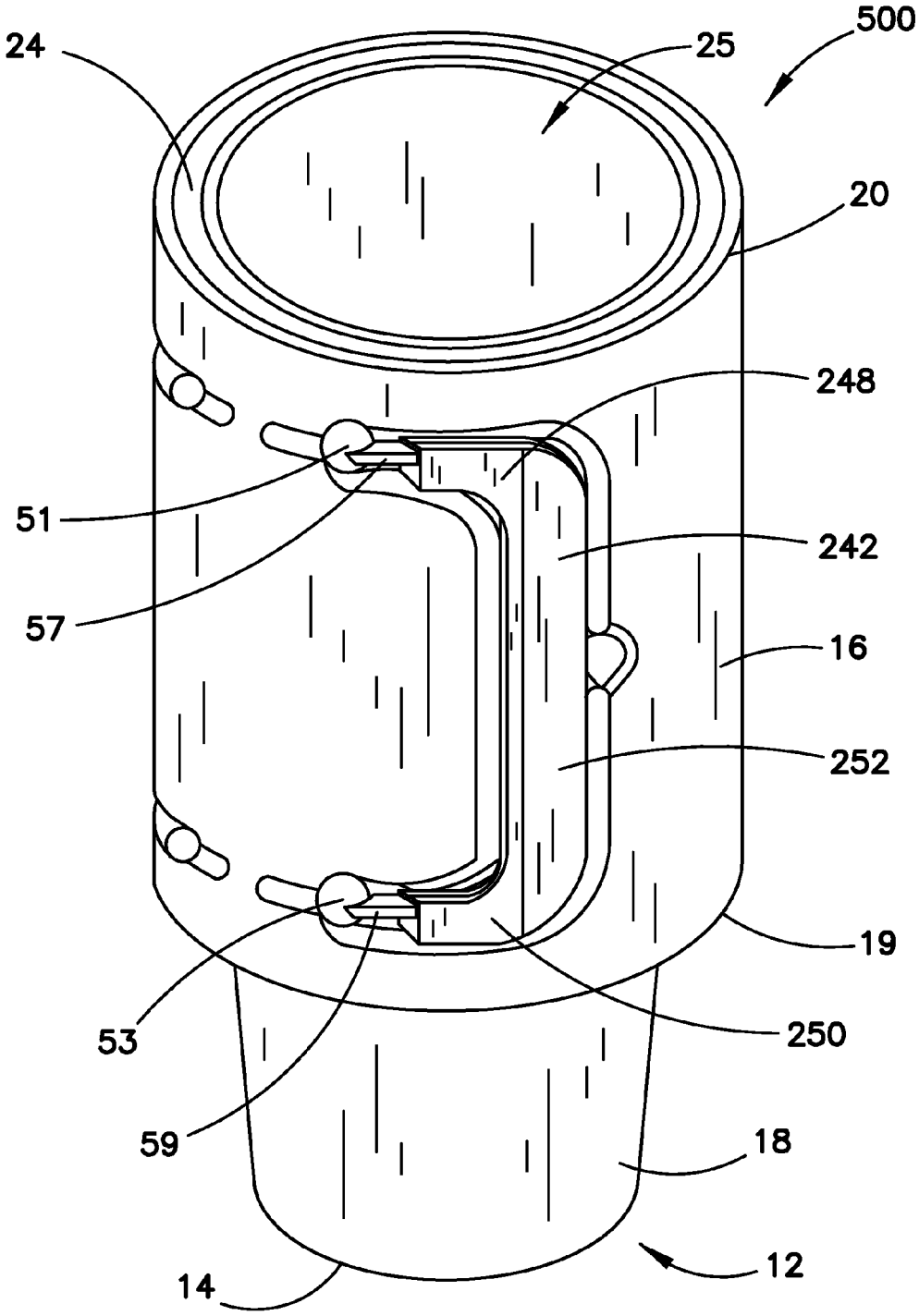
FIG. 24 is a perspective view of the coffee mug of FIG. 23 with the handles shown received in the sidewall recesses.
Figure 25:
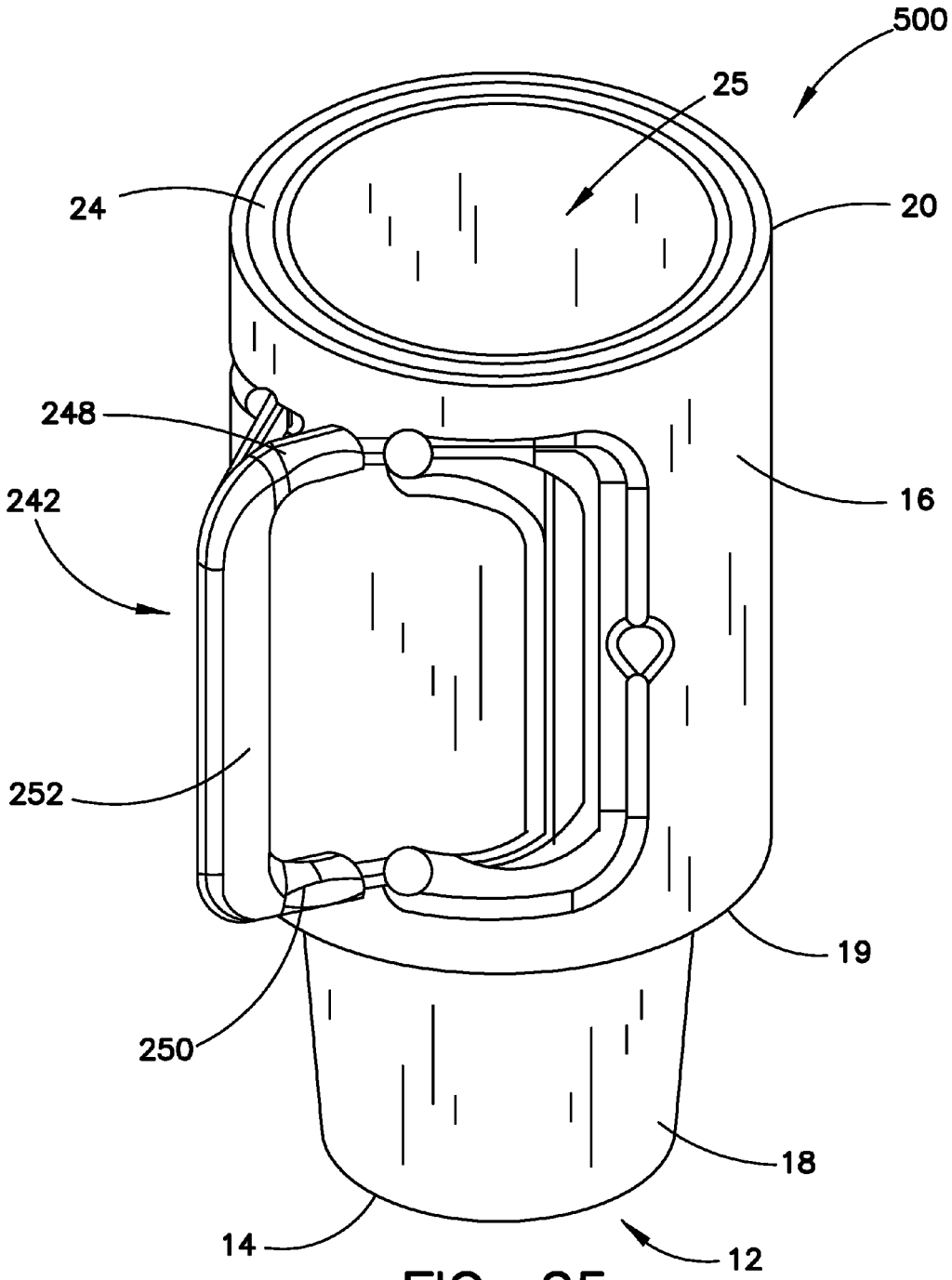
FIG. 25 is a perspective view of the coffee mug of FIG. 23 with the handles shown protruding from the sidewall recesses.

The handle 242 shown in FIGS. 14 and 15 can also be used in conjunction with the container 500 shown in FIGS. 23-25. The container 500 is seen to have the general shape of a coffee mug or similar article including a base 12 having an essentially planar bottom 14. The container 500 can be formed of plastic, metal, glass and other materials. An outer sidewall 16 can extend upward from the base 12. The outer sidewall 16 can include a lower margin 18 that is continuously joined to the base 12, and an upper margin 20. While the upper and lower margins 18 and 20 of outer sidewall 16 are shown to be circular, so that the sidewall is generally cylindrical, other shapes are also possible. A step 19 can be provided between the upper and lower margins 18 and 20 to further define the outer sidewall 16 into a smaller lower diameter and a larger upper diameter. A finish 24 can be continuously joined to the sidewall upper margin 20 to surround an opening 25 into the container 500. An interior or exterior surface of the finish 24 can be threaded or otherwise adapted to receive a closure, not shown. The sidewall can be made of a single layer of material or multiple layers of material to enhance the thermal retention properties of the container 500, thus forming a thermos-like article. When formed of multiple layers of material, an innermost layer can omit some or all of the features found in the outer sidewall 16.

The outer sidewall 16 can additionally include a pair of recesses 28, 30 situated on opposite sides of a midline M, which can be vertical and arranged parallel to an axis Y of the container 500. The recesses 28, 30 are shown to be indentations into larger diameter portions of the outer sidewall 16 including an upper leg 32, a lower leg 34 and a middle portion 36 forming a continuous trough in the outer sidewall 16. A socket 37 is provided at the end of the upper leg 32 and the lower leg 34 nearest to the midline M. A wedge-shaped slot 39 can extend from each of the sockets 37 toward the midline M.

The handles 242 can be suitably dimensioned to be received wholly within the pair of recesses 28, 30 in the outer sidewall 16 of container 500. Each handle 242 can each include an upper portion 248, a lower portion 250, and a middle portion 252 that can join the upper and lower portions into a one-piece unitary formation. A ball shaped end 51 and 53 can be connected to the upper portion 48, and the lower portion 50, respectively, by web portions 57 and 59. The ball shaped ends 51 and 53 can be received in the sockets 37 at the inner ends of sidewall recesses 28 and 30 so that the handles 242 can be wholly received within the recesses 28, 30 as shown in FIG. 24. The ball shaped ends 51 and 53 permit the handles to be displaced from the recessed position shown in FIG. 24 to a projecting position as shown in FIG. 25. This displacement causes the web portions 57 and 59 to enter into slots 39 so that the middle portions 252 of the handles 242 are sufficiently close to each other to permit the handles 242 to be grasped in one hand by a user of the container 500.

While these features have been disclosed in connection with the illustrated preferred embodiments, other embodiments of the invention that come within the spirit of the invention as defined in the following claims will be apparent to those skilled in the art.

The invention claimed is:

1. A container comprising:

a base, a sidewall extending upward from the base, a finish at an upper margin of the sidewall surrounding an opening into an interior of the container enclosing a prescribed volume, the sidewall including a pair of recesses situated on opposite sides of a vertical midline, each of the recesses including upper and lower sockets situated at upper and lower ends of the recesses; and a pair of handle elements adapted to be received wholly within the pair of recesses in the sidewall, each of the handle elements including upper and lower ball portions received in the upper and lower sockets situated at upper and lower ends of one of the recesses, the ball portions being pivotable within the socket portions so as to permit the handle elements to be displaced from within the sidewall recesses to a position projecting outward from the sidewall sufficiently to permit the pair of handle elements to be grasped in one hand, at least one of the upper and lower ball portions is non-spherical so as to provide a detent biasing the handle elements toward a fully retained or a fully projecting position.

2. The container of claim 1, wherein the vertical midline is arranged parallel to an axis of the bottle.

3. The container of claim 1, wherein web portions connect the ball portions of each handle element to the upper and lower ends of each handle element, and wherein the sidewall further includes slots extending from the socket portions away from the trough portions to receive the web portions when the handle is moved to project outward from the sidewall.

4. A container comprising:

a base, a sidewall extending upward from the base, a finish surrounding an opening into the container, the sidewall including at least one recess, each recess including an upper generally horizontal portion and a lower generally horizontal portion, a trough portion connecting one end of the upper generally horizontal portion to one end of the lower generally horizontal portion, each of the upper and lower horizontal portions including socket portion at an end opposite the trough portion; and at least one handle element adapted to be received wholly within each recess in the sidewall, each handle element including a middle portion and a ball portion connected to upper and lower ends of each handle element, the ball portions being received in the socket portions of each recess, the ball portions being pivotable within the socket portions so as to permit the middle portion of each handle element to be displaced from within each sidewall recess to a position projecting outward from the sidewall sufficiently to permit the middle portion of the handle to be grasped in one hand, wherein at least one of the ball portions of each handle element further comprises a projecting portion adapted to interact with the adjacent socket so as to provide a detent biasing each handle toward either a fully retained or a fully projecting position.

5. The container of claim 4, wherein the container sidewall is formed of a single layer of material.

6. The container of claim 4, wherein the container sidewall is formed of multiple layers of material.

7. The container of claim 6, wherein the at least one recess is present in an outermost layer of the multiple layers of material.

8. The container of claim 4, further comprising a pintle member extending vertically between the ball portions of each handle element.

9. The container of claim 4, wherein the at least one recess comprises a pair of recesses arranged generally parallel to each other with the socket portions being situated closer to each other than the trough portions, and wherein the at least one handle element comprises a pair of handle elements, one of the pair of handle elements being received in each of the recesses.

10. The container of claim 9, wherein the pair of handle elements are adapted to be displaced from within the pair of sidewall recess to a position projecting outward from the sidewall sufficiently to permit the middle portions of the pair of handle elements to contact each other and be grasped in one hand.

11. The container of claim 4, further comprising a shoulder continuously joined to an upper margin of the sidewall and extending upward and inward from the sidewall to the finish, the finish being adapted to receive a closure.

12. The container of claim 4, wherein web portions connect the ball portions of each handle element to the upper and lower ends of each handle element, and wherein the sidewall further includes slots extending from the socket portions away from the trough portions to receive the web portions when the handle is moved to project outward from the sidewall.

13. A container comprising:

a base, a sidewall extending upward from the base, a finish surrounding an opening into the container, the sidewall including a pair of recesses horizontally spaced from each other, each recess including an upper generally horizontal portion and a lower generally horizontal portion, a trough portion connecting one end of the upper generally horizontal portion to one end of the lower generally horizontal portion, each of the upper and lower horizontal portions including socket portion at an end opposite the trough portion, the pair of recesses being oriented so that the socket portions are situated closer to each other than the trough portions; and at least one handle element adapted to be received wholly within each recess in the sidewall, each handle element including a middle portion and a ball portion connected to upper and lower ends of each handle element, the ball portions being received in the socket portions of each recess, the ball portions being pivotable within the socket portions so as to permit the middle portion of each handle element to be displaced from within each sidewall recess to a position projecting outward from the sidewall sufficiently to permit the middle portion of the pair of handle elements to contact each other and be grasped in one hand.

14. The container of claim 13, wherein at least one of the ball portions of each handle element further comprises a projecting portion adapted to interact with the adjacent socket so as to provide a detent biasing each handle toward either a fully retained or a fully projecting position.

15. The container of claim 13, further comprising a pintle member extending vertically between the ball portions of each handle element.

16. The container of claim 13, wherein the container sidewall is formed of a single layer of material.

17. The container of claim 13, wherein the container sidewall is formed of multiple layers of material.

18. The container of claim 17, wherein the pair of recesses are present in an outermost layer of the multiple layers of material.

19. The container of claim 13, wherein web portions connect the ball portions of each handle element to the upper and lower ends of each handle element, and wherein the sidewall further includes slots extending from the socket portions away from the trough portions to receive the web portions when the handle is moved to project outward from the sidewall.

* * * * *